US008919268B2

(12) United States Patent
Chen

(10) Patent No.: US 8,919,268 B2
(45) Date of Patent: Dec. 30, 2014

(54) SEWING MACHINE NEEDLE BAR CHANGING DEVICE

(71) Applicant: Chee Siang Industrial Co., Ltd., New Taipei (TW)

(72) Inventor: Man Chuing Chen, New Taipei (TW)

(73) Assignee: Chee Siang Industrial Co., Ltd., New Taipei (TW)

( * ) Notice: Subject to any disclaimer, the term of this patent is extended or adjusted under 35 U.S.C. 154(b) by 0 days.

(21) Appl. No.: 13/851,759

(22) Filed: Mar. 27, 2013

(65) Prior Publication Data

US 2014/0290548 A1 Oct. 2, 2014

(51) Int. Cl.
*D05B 55/16* (2006.01)
*D05B 55/10* (2006.01)

(52) U.S. Cl.
CPC ..... *D05B 55/10* (2013.01)
USPC ..... 112/163; 112/221

(58) Field of Classification Search
CPC ..... D05B 51/00; D05B 69/12; D05B 55/14; D05B 55/16; D05B 55/00; D05B 55/02; D05B 55/10; D05B 69/00; D05C 15/20
USPC ..... 112/163, 220, 221, 155, 470.01, 80.43
See application file for complete search history.

(56) References Cited

U.S. PATENT DOCUMENTS

| | | | | | |
|---|---|---|---|---|---|
| 3,118,403 | A * | 1/1964 | Chambers | 112/80.43 |
| 4,075,958 | A * | 2/1978 | Sacchetti | 112/163 |
| 4,301,756 | A * | 11/1981 | Teetz et al. | 112/221 |
| 4,531,467 | A * | 7/1985 | Golia et al. | 112/155 |
| 4,719,865 | A * | 1/1988 | Yokoe et al. | 112/221 |
| 5,390,613 | A * | 2/1995 | Shibata | 112/80.43 |
| 5,957,069 | A * | 9/1999 | Shibata | 112/155 |
| 7,654,209 | B2 * | 2/2010 | Park | 112/220 |

* cited by examiner

*Primary Examiner* — Ismael Izaguirre
(74) *Attorney, Agent, or Firm* — Rabin & Berdo, P.C.

(57) ABSTRACT

A sewing machine needle bar changing device includes a needle bar case having multiple needle bar holes, each of which receives a needle bar and has at least one longitudinal slide way formed on one side thereof; a needle bar case holder located at one side of the needle bar case and having a control guide way, which is engaged with the needle bars and has a longitudinal opening; a needle bar guide member engaged with one needle bar that is moved to a sewing position to align with the longitudinal opening, and brought by a crank link of the sewing machine to move upward and downward synchronously with the engaged needle bar; and a driving mechanism for moving and then holding a selected needle bar to the sewing position. All other needle bars not in the sewing position are restricted by the control guide way from moving axially.

8 Claims, 26 Drawing Sheets

SEWING MACHINE NEEDLE BAR CHANGING DEVICE

FIELD OF THE INVENTION

The present invention relates to a needle bar mechanism for installing on a sewing head of a sewing machine, and more particularly to a needle bar changing device that allows the needle bars within the same one sewing head to be changed from one to another while the sewing reference point for that sewing head is unchanged.

BACKGROUND OF THE INVENTION

In FIG. 1, there is shown a conventional linear-type multi-head sewing machine, which includes a machine table 10, a machine frame 11 upward extended from the machine table 10, a plurality of sewing heads 12 mounted on the machine frame 11 to space from one another, a plurality of needle plates 13 disposed on the machine table 10 at positions opposite to the respective sewing heads 12 and having an extending direction perpendicular to that of the sewing heads 12, a plurality of rotating shuttles (not shown) disposed below respective needle plates 13 to cooperate with the sewing heads for sewing operation, a substantially rectangular supporting frame 14 provided on a top of the machine table 10 for supporting a workpiece thereon, and a driving mechanism (not shown) coupled to the supporting frame 14 for driving the supporting frame 14 to horizontally move on the top of the machine table 10 in the x-direction and the y-direction. On each of the sewing heads 12, a plurality of needle bars 15 is linearly arranged to supply different types of threads. Therefore, any desired one of the needle bars 15 can be selected for stitching with a desired type of thread.

However, according to the above-described multi-head sewing machine, the needle bars 15 on each sewing head 12 are usually linearly arranged, and every needle bar 15 has a fixed lowering position. Therefore, each needle plate 13 for feeding the workpiece on the machine table 10 must have a size large enough to cover an overall width of all the needle bars linearly arrayed on the corresponding sewing head 12 as well as an overall width of a stitching area on the workpiece. As a result, the supporting frame 14 on the machine table 10 would be very large in volume. Moreover, in practical sewing operation, in case there is a large number of needle bars 15 provided on each of the sewing heads 12, it is necessary to increase the driving mechanism's travel distance in the x-direction, so that the same point of the workpiece on the machine table 10 can be moved to the positions corresponding to the leftmost and the rightmost needle bar 15 on the sewing head 12 for stitching.

To reduce the driving mechanism's travel distance in the x-direction, a conventional round-type multi-head sewing machine as shown in FIG. 2 has been developed. The round-type multi-head sewing machine similarly includes a machine table 16, a supporting frame 17 upward extended from the machine table 16 for supporting a plurality of spaced sewing heads 18 thereon, and a plurality of needle bars 19 arrayed on each of the sewing heads 18. Unlike the conventional linear-type multi-head sewing machine, the needle bars 19 in the round-type multi-head sewing machine are circumferentially arranged on each of the sewing heads 18 for supplying different threads. While the circumferential arrangement of the needle bars 19 on each of the sewing heads 18 indeed reduces the x-direction travel distance, every needle bar 19 on the sewing heads 18 still has a fixed lowering position. In case there is a large number of needle bars 19 provided on each of the sewing heads 18, an increased x-direction travel distance on the machine table 16 is still needed.

In view that the conventional multi-head sewing machines have the drawbacks of having a very large volume and requiring an extended x-direction travel distance for the driving mechanism, it is therefore tried by the inventor to develop an improved sewing machine needle bar changing device in order to overcome the drawbacks in the conventional multi-head sewing machines.

SUMMARY OF THE INVENTION

A primary object of the present invention is to provide a sewing machine needle bar changing device, with which needle bars and accordingly sewing threads on the same one sewing head on a multi-head sewing machine can be quickly and easily changed from one to another for stitching according to actual need in sewing operation while the sewing reference point and the needle plate for that sewing head are unchanged.

Another object of the present invention is to provide a sewing machine needle bar changing device that includes means for preventing the individual needle bars from rotating and limiting their axial motion, so that the needle bar moved to and located at a sewing position is allowed to axially move upward and downward while all other needle bars not located at the sewing position are not axially movable.

A further object of the present invention is to provide a sewing machine needle bar changing device, of which a needle bar case can be differently configured to allow needle bars to be circumferentially, linearly or curvilinearly arrayed thereon, so that a most suitably structured needle bar case can be conveniently selected for use according to the model of the sewing machine and the size of the sewing head thereof, so that the present invention provides effectively increased convenience in assembling as well as widened usability and applicability.

To achieve the above and other objects, the sewing machine needle bar changing device according to the present invention includes a needle bar case, a needle bar case holder, a plurality of needle bars each carrying a needle, a needle bar guide member, and a driving mechanism.

The needle bar case has a plurality of spaced needle bar holes, and each of the needle bar holes is provided on at least one side of its wall with at least one longitudinal slide way, which communicates the needle bar hole with an external space. The needle bar case holder is located at one side of the needle bar case and has a control guide way formed thereon, and the control guide way has a longitudinal opening. The needle bars are received in the needle bar holes in one-to-one correspondence and are engaged with the respective longitudinal slide ways and the control guide way. The needle bar guide member is engaged with one of the needle bars that is moved to align with the longitudinal opening, and is connected to and brought by a crank link on the sewing machine to move upward and downward. Finally, the driving mechanism can bring the needle bar case to displace and provide a locating function, so that one of the needle bar holes is selectively moved to a sewing position, at which the needle bar in the selected needle bar hole is in line with the longitudinal opening and the needle bar guide member.

With these arrangements, the needle bar being selectively moved to and located at the sewing position can be brought by the needle bar guide member to axially move upward and downward synchronously with the needle bar guide member, while all other needle bars that are not located at the sewing position are restricted by the control guide way from axially moving upward and downward.

In a preferred embodiment of the present invention, the needle bar case holder and the needle bar guide member are located at the same side of the needle bar case. In this case, the needle bars respectively have a first protrusion for engaging with the control guide way, and the needle bar guide member has a first recess corresponding to the first protrusions, so that the needle bar located at the sewing position can move synchronously with the needle bar guide member through engagement of the first protrusion with the first recess. Alternatively, the needle bars respectively may have a recess for engaging with the control guide way, and the needle bar guide member has a protrusion corresponding to the recesses on the needle bars.

In another preferred embodiment of the present invention, the needle bar case holder and the needle bar guide member are located at two opposite sides of the needle bar case. In this case, the needle bars respectively have a first protrusion and a second protrusion formed thereon, and the needle bar guide member has a first recess corresponding to the first protrusions; the second protrusions are engaged with the control guide way; and the first protrusion on the needle bar that is located at the sewing position is engaged with the first recess for the needle bar to move synchronously with the needle bar guide member.

In the above two preferred embodiments, the contact surfaces between each first protrusion and the first recess are configured as a protuberance and a corresponding hollow. In the present invention, the needle bar holes can be circumferentially, linearly or curvilinearly arranged on the needle bar case; and the needle bar case can be driven by the driving mechanism to rotate, displace linearly, or sway from side to side, so as to change the positions of the needle bar holes relative to the needle bar guide member.

Further, the driving mechanism for the present invention further includes a driving motor and a transmission unit. The driving motor has a driving shaft; the transmission unit has an end connected to the driving shaft and another end connected to the needle bar case. In an operable embodiment, the transmission unit can be any one of a gear set, a belt-driving unit, a guide screw unit, an actuator, an electrical driving unit and other final controlling elements.

According to the present invention, the control guide way can be configured as a groove or a rabbet formed on a wall surface of the needle bar case holder, and the needle bars are respectively provided with a protrusion corresponding to the groove or the rabbet. Alternatively, the control guide way can be configured as an annular flange formed on around the wall surface of the needle bar case holder, and the needle bars respectively have a recess corresponding to the annular flange or a stopper pressing against a top of the annular flange, so that the needle bars are restricted by the control guide way from axially moving upward and downward.

The present invention is characterized in that the needle bars in the needle bar case can be selectively moved to align and engage with the needle bar guide member that is located at a fixed position, so that sewing threads on the same one sewing head of the sewing machine can be directly changed for stitching according to actual need in sewing operation while the sewing reference point and the needle plate for that sewing head are unchanged.

Further, the needle bar case and the needle bar case holder in the present invention are respectively provided with longitudinal slide ways and a control guide way, which together effectively prevent the needle bars from rotating relative to the needle bar holes and limit them from axially moving upward and downward. With these arrangements, only the selected needle bar, i.e. the needle bar at the sewing position, is allowed to axially move upward and downward, while the rest needle bars are not axially movable.

In addition, since the needle bar case for the present invention can be differently configured to allow the needle bars to be circumferentially, linearly or curvilinearly arrayed thereon, a most suitably structured needle bar changing device can be conveniently selected for use according to the model of the sewing machine and the size of the sewing head thereof, enabling the present invention to provide effectively increased convenience in assembling as well as widened usability and applicability.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
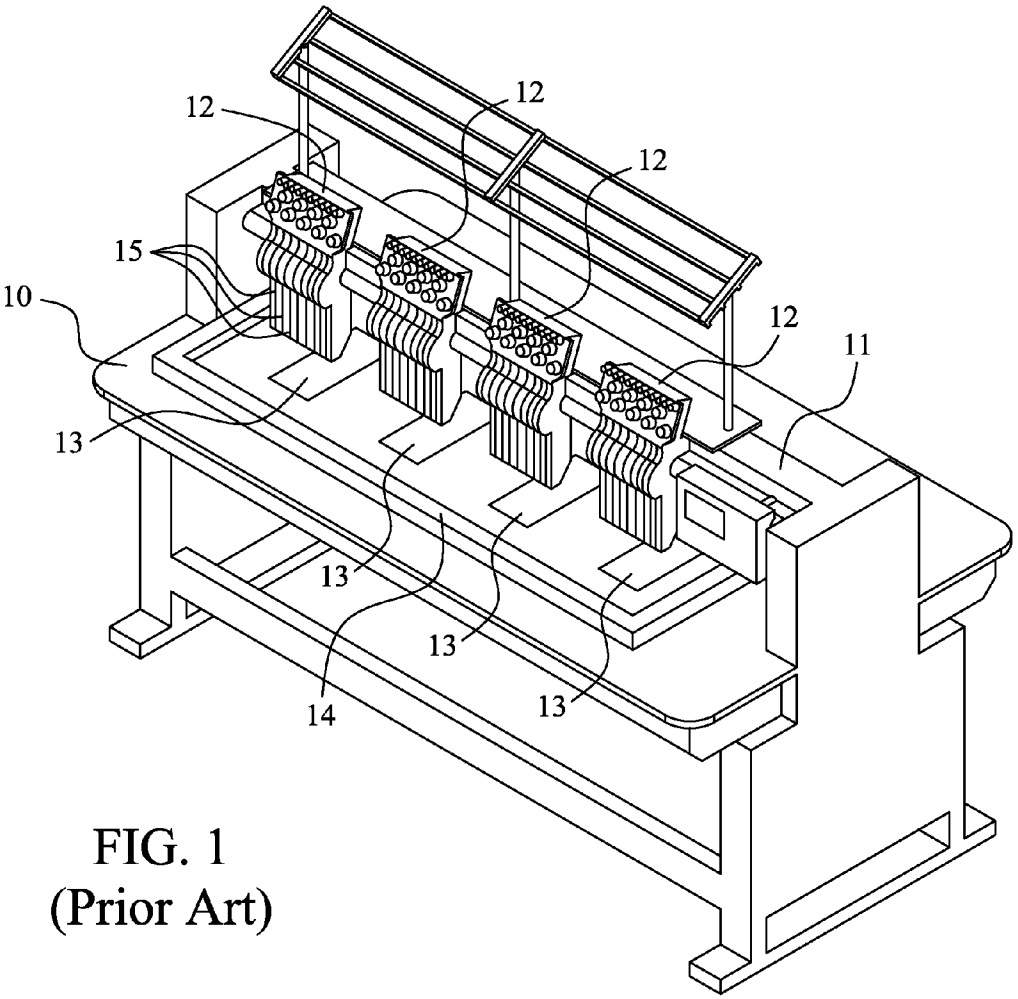
FIG. 1 (Prior Art)
FIG. 1 is a perspective view of a conventional multi-head sewing machine having a plurality of needle bars linearly arranged on each sewing head thereof.
Figure 2:
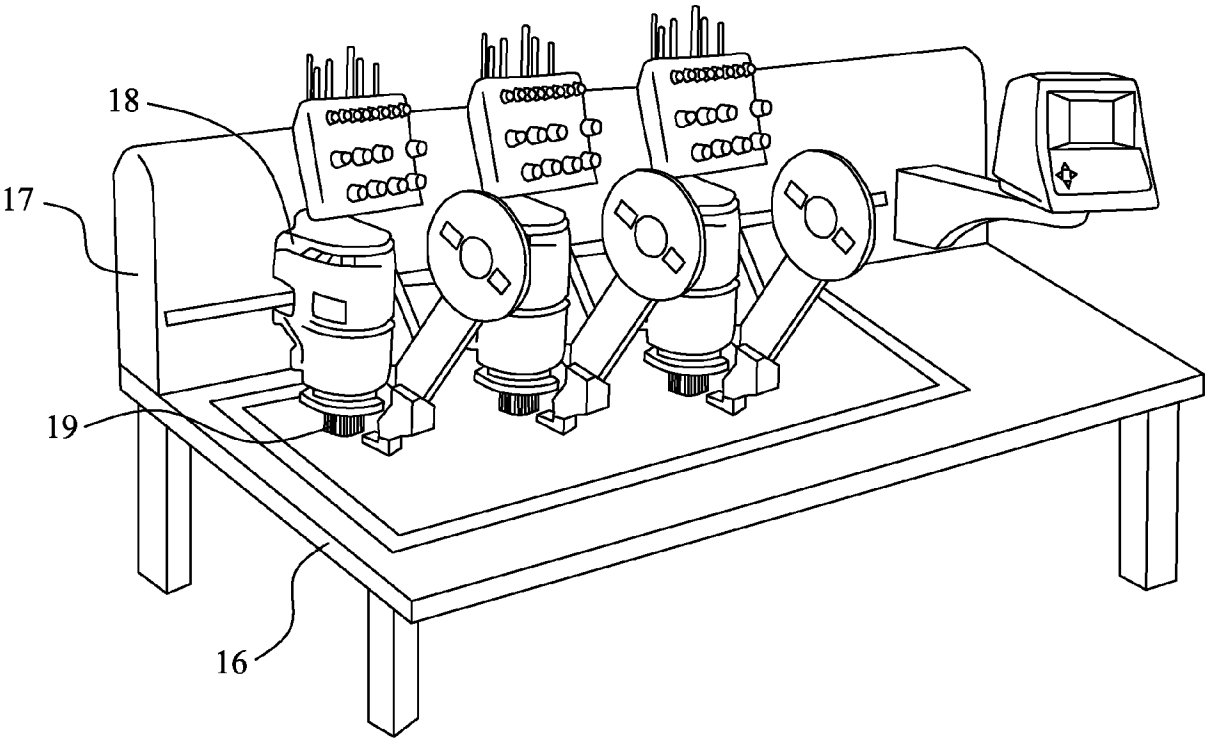
FIG. 2 (Prior Art)
FIG. 2 is a perspective view of another conventional multi-head sewing machine having a plurality of needle bars circumferentially arranged on each sewing head thereof.

The present invention will now be described with some preferred embodiments thereof and with reference to the accompanying drawings. For the purpose of easy to understand, elements that are the same in the preferred embodiments are denoted by the same reference numerals.

Figure 3:
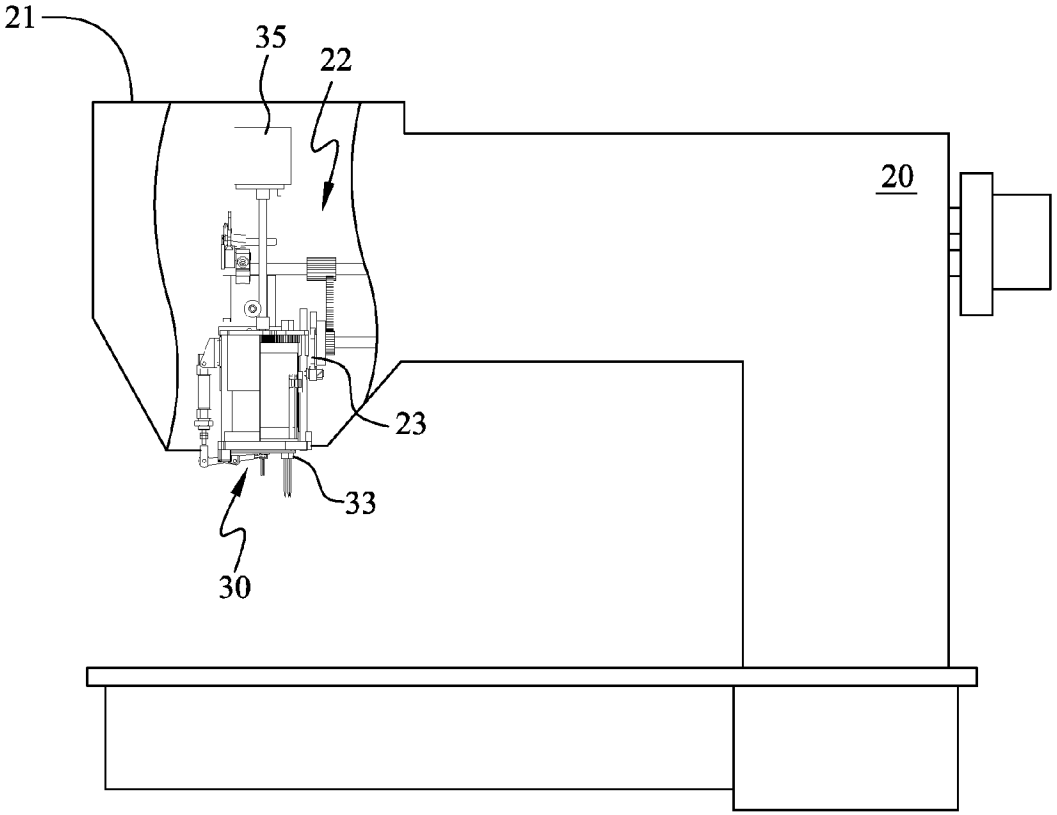
FIG. 3 is a schematic side view showing the position on each sewing head of a multi-head sewing machine at where a sewing machine needle bar changing device according to the present invention is installed.

Please refer to FIG. 3. The present invention is a sewing machine needle bar changing device 30 installed on a needle bar mechanism 22 in a sewing head 21 of a sewing machine 20, and is particularly connected to a crank link 23 of the needle bar mechanism 22, so that a needle bar 33 currently located at a sewing position can be changed with another one via a driving mechanism 35 having a locating function.

Figure 4:
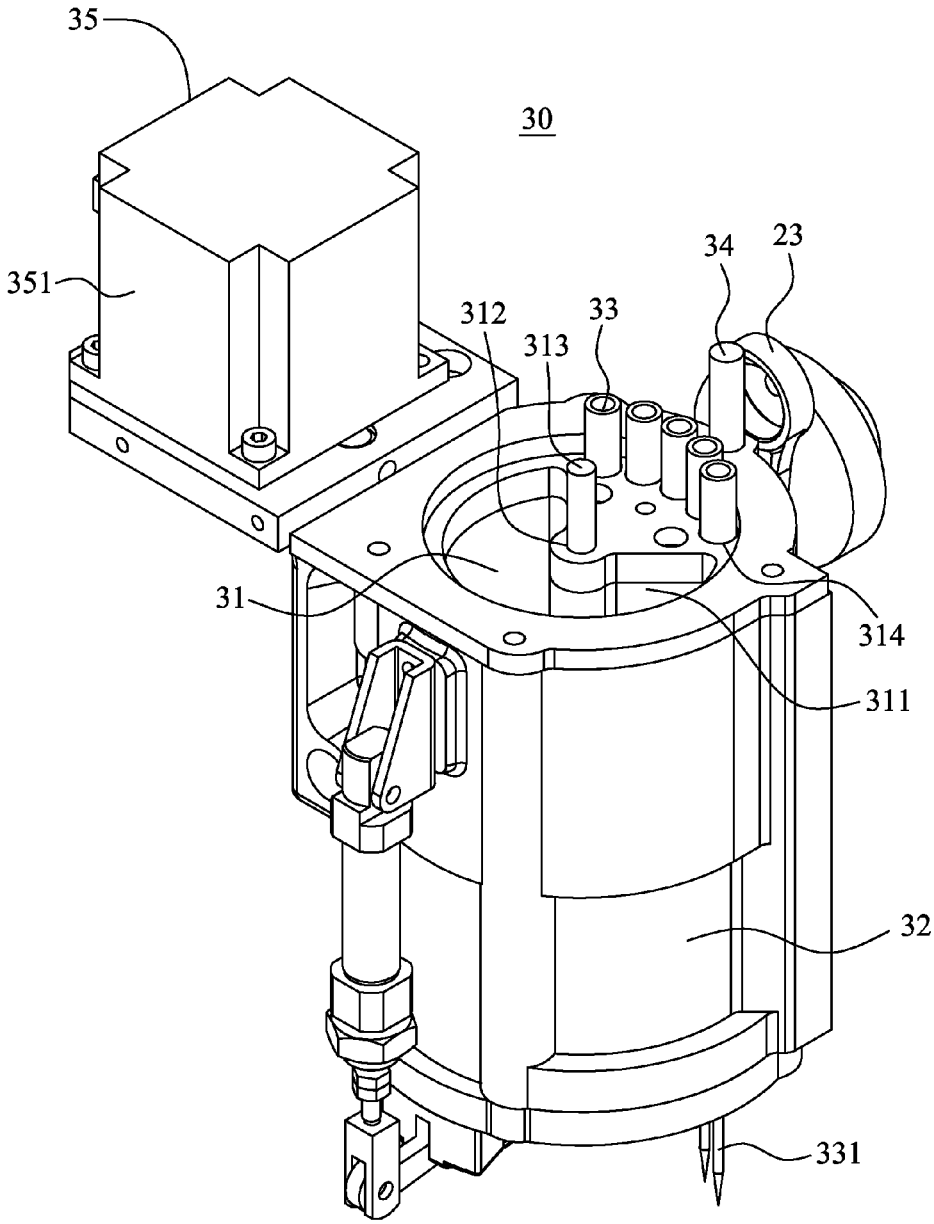
FIG. 4 is an assembled perspective view of a round-type sewing machine needle bar changing device according to a first preferred embodiment of the present invention.
Figure 5:
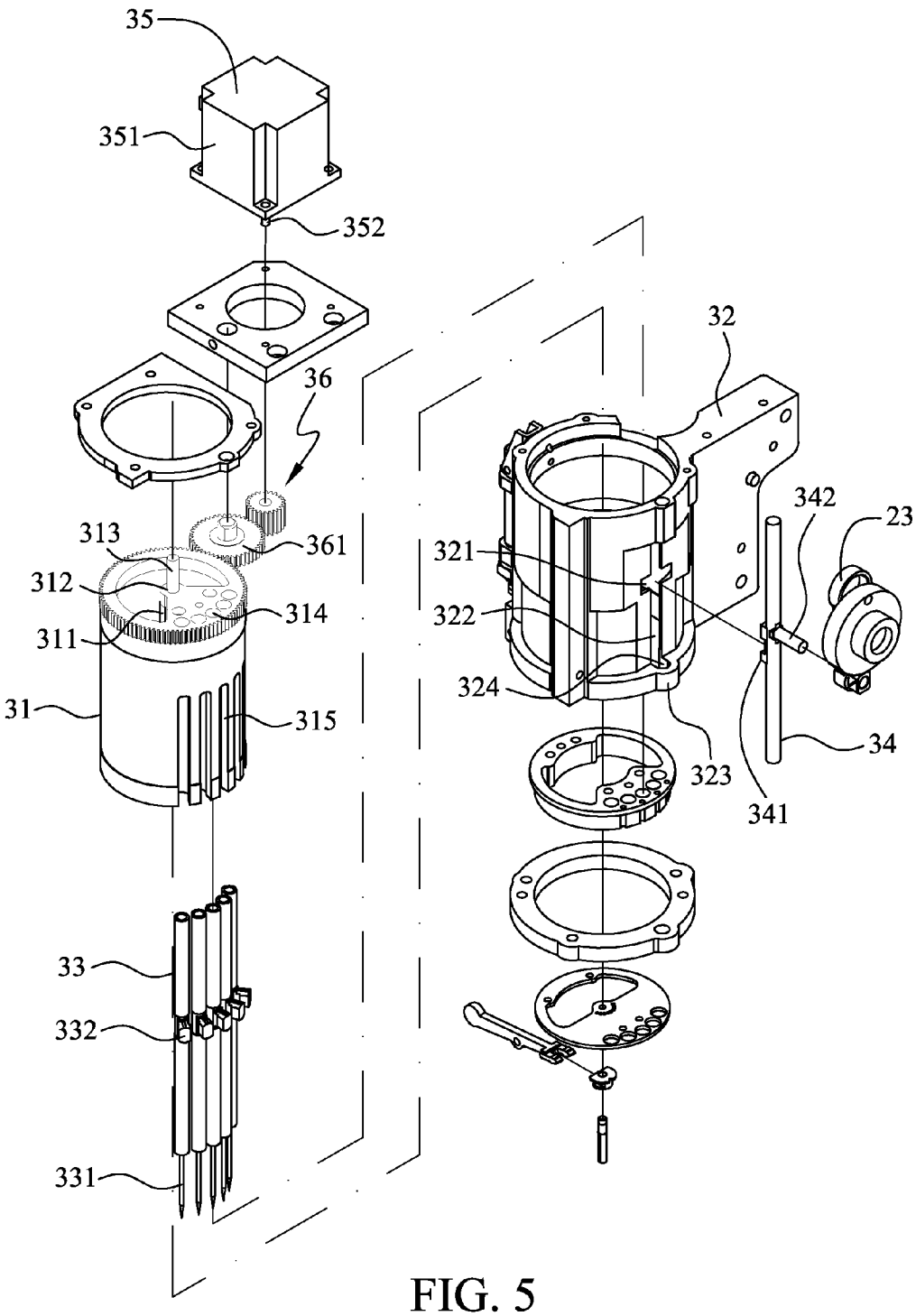
FIG. 5 is an exploded view of FIG. 4.
Figure 6:
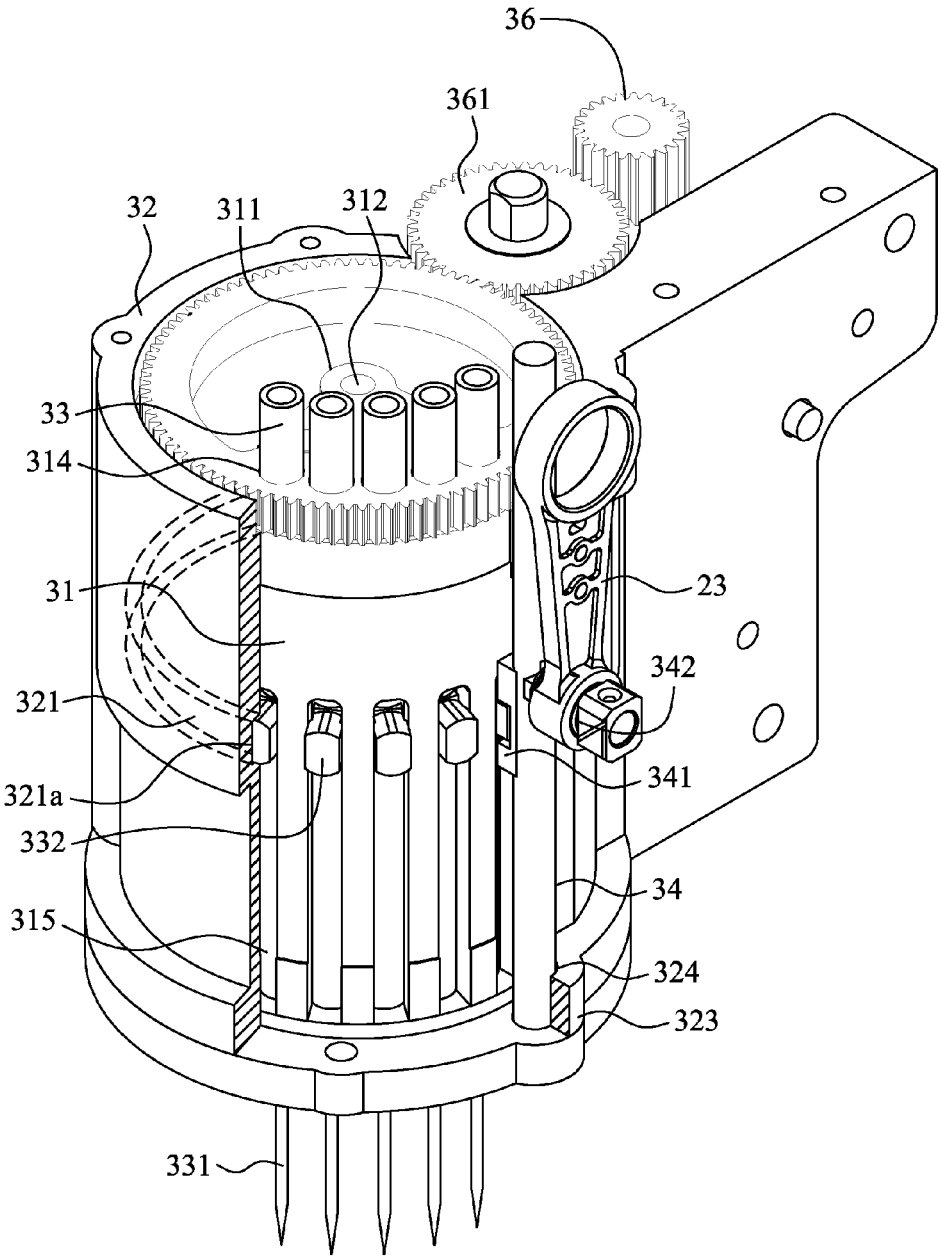
FIG. 6 is a partially cut-away view of FIG. 4.

Please refer to FIGS. 4 to 6. According to a first preferred embodiment of the present invention, the sewing machine needle bar changing device 30 includes a cylindrical needle bar case 31, a cylindrical needle bar case holder 32, a plurality of needle bars 33 each carrying a needle 331, a needle bar guide member 34, and a driving mechanism 35.

The cylindrical needle bar case 31 has a pivoting section 311 radially inward extended from an inner side to a center thereof. The pivoting section 311 has a shaft hole 312 formed at a position corresponding to an axial center of the cylindrical needle bar case 31 for a pivot shaft 313 to extend therethrough. The cylindrical needle bar case 31 is provided along its wall with several circumferentially spaced needle bar holes 314, and on its outer wall surface with several longitudinal slide ways 315 corresponding to the needle bar holes 314. The longitudinal slide ways 315 are extended parallel to the axial center of the cylindrical needle bar case 31 and communicate their corresponding needle bar holes 314 with an outer space. The longitudinal slide ways 315 are extended from a near central section down to a lower end of the outer wall surface of the cylindrical needle bar case 31, allowing the needle bars 33 to be conveniently upward extended into the needle bar holes 314 from the lower ends of the longitudinal slide ways 315.

The cylindrical needle bar case holder 32 is fitted around the outer side of the cylindrical needle bar case 31, and is provided on an inner wall surface with a horizontally extended control guide way 321, which is located outside and faced toward the upper ends of all the longitudinal slide ways 315. The control guide way 321 further includes a longitudinal opening 322, which communicates an inner and an outer side of the cylindrical needle bar case holder 32 with each other. Two radially outward protruded portions 323 are formed on the cylindrical needle bar case holder 32 corresponding to an upper and a lower end of the longitudinal opening 322, and are respectively provided with a through hole 324.

The needle bars 33 are received in the needle bar holes 314 of the cylindrical needle bar case 31 in one-to-one correspondence. Each of the needle bars 33 has a first protrusion 332 formed thereon for radially outward extending through the longitudinal slide way 315 to engage with the longitudinal opening 332 of the control guide way 321, such that the first protrusion 332 of the needle bar 33 engaging with the longitudinal opening 332 has a predetermined length exposed from the longitudinal opening 322.

In the illustrated first preferred embodiment, the needle bar guide member 34 is located outside the longitudinal opening 322 of the cylindrical needle bar case holder 32, and has two opposite ends extended into the through holes 324 on the two protruded portions 323 to thereby be held in place on the needle bar case holder 32. The needle bar guide member 34 has a first recess 341 formed thereon for correspondingly engaging with the exposed partial length of the first protrusion 332 of the needle bar 33, enabling the needle bar 33 and the needle bar guide member 34 to move synchronously. A connecting arm 342 is also formed on one side of the needle bar guide member 34 opposite to the first recess 341 for connecting to the crank link 23, such that the needle bar guide member 34 is brought by the crank link 23 to move upward and downward.

Figure 7:
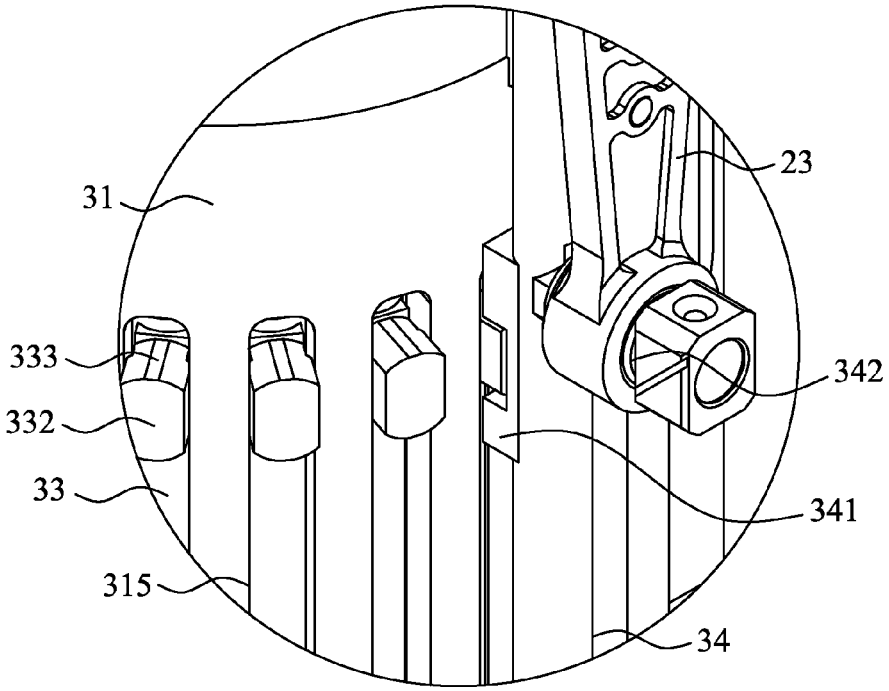
FIG. 7 is a partially enlarged view of FIG. 6 showing the engagement of one needle bar with a needle bar guide member.

Please refer to FIG. 7. For the first protrusion 332 on the needle bar 33 to more smoothly and firmly engage with the first recess 341 on the needle bar guide member 34, upper and lower faces of the first protrusion 332 in contact with the upper and lower faces of the first recess 341 are respectively provided at two lateral sides with two beveled guiding surfaces and thereby have a slightly raised configuration 333.

Figure 8:
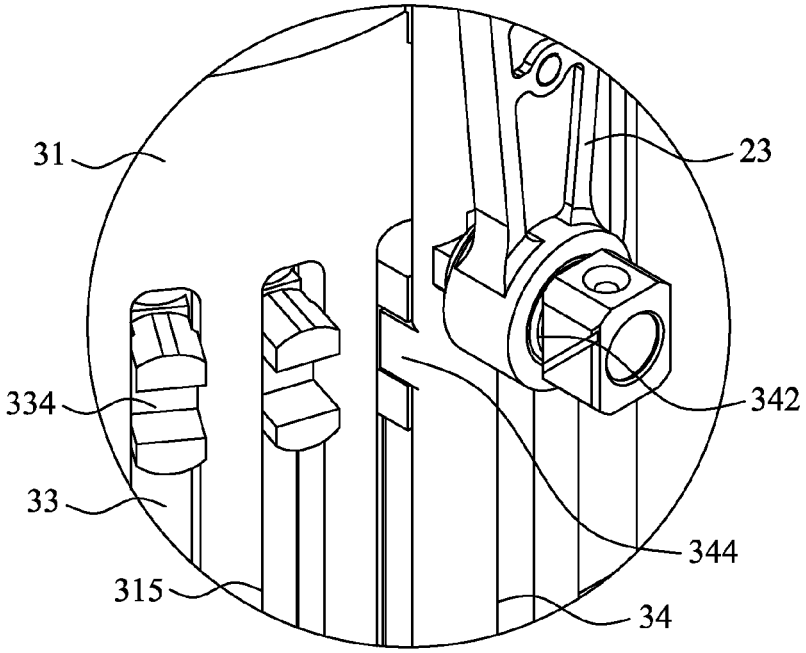
FIG. 8 is a partially enlarged view showing the engagement of one needle bar with the needle bar guide member according to a variant of the first preferred embodiment of the present invention.

However, it is understood the above described way of engagement between the needle bar 33 and the needle bar guide member 34 is only illustrative and not intended to limit the present invention in any way. For example, the first protrusion 332 and the first recess 341 can be exchanged in position according to a variant of the first preferred embodiment of the present invention as shown in FIG. 8. Therefore, the needle bar 33 can be provided with a recess 334 similar to the first recess 341 while the needle bar guide member 34 can be correspondingly provided with a protrusion 344 similar to the first protrusion 332 for engaging with the recess 334. Alternatively, other different types of engaging structures can be provided on between the needle bar 33 and the needle bar guide member 34 to achieve the same function.

Please refer to FIGS. 5 and 6 again. The driving mechanism 35 includes a driving motor 351 and a transmission unit 36. The driving motor 351 is a step motor with a locating function and has a driving shaft 352, which cooperates with the transmission unit 36 to move the cylindrical needle bar case 31. The transmission unit 36 is configured as a gear set 361 consisting of three gears. The gear set 361 has an end rotatably connected to the driving shaft 352 and another end meshed with a toothed wheel formed around an upper end of the cylindrical needle bar case 31, so as to drive the cylindrical needle bar case 31 to rotate about the pivot shaft 313 and therefore change the position of every needle bar hole 314 on the cylindrical needle bar case 31 relative to the needle bar guide member 34.

Figure 9:
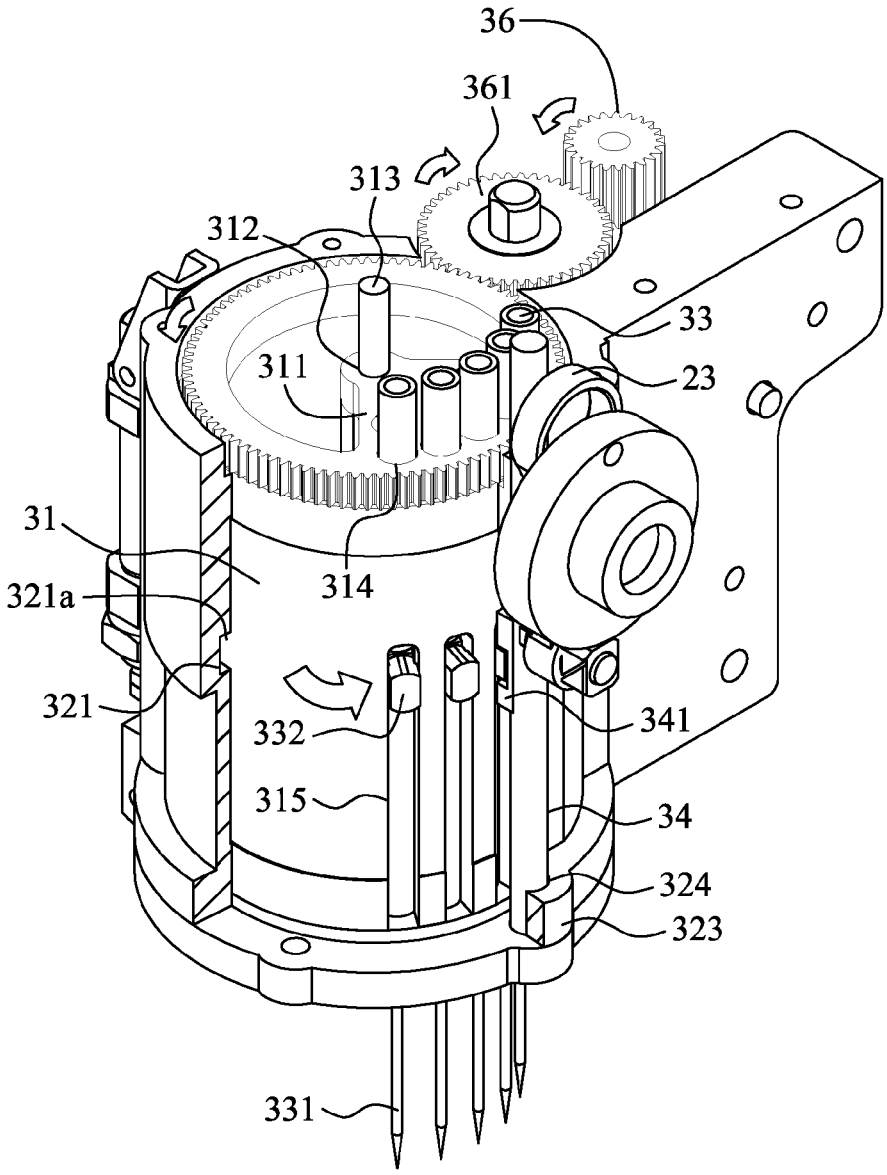
FIG. 9 is a partially cut-away view showing the sewing machine needle bar changing device according to the first preferred embodiment of the present invention is driven to change the needle bars for one to another.
Figure 10:
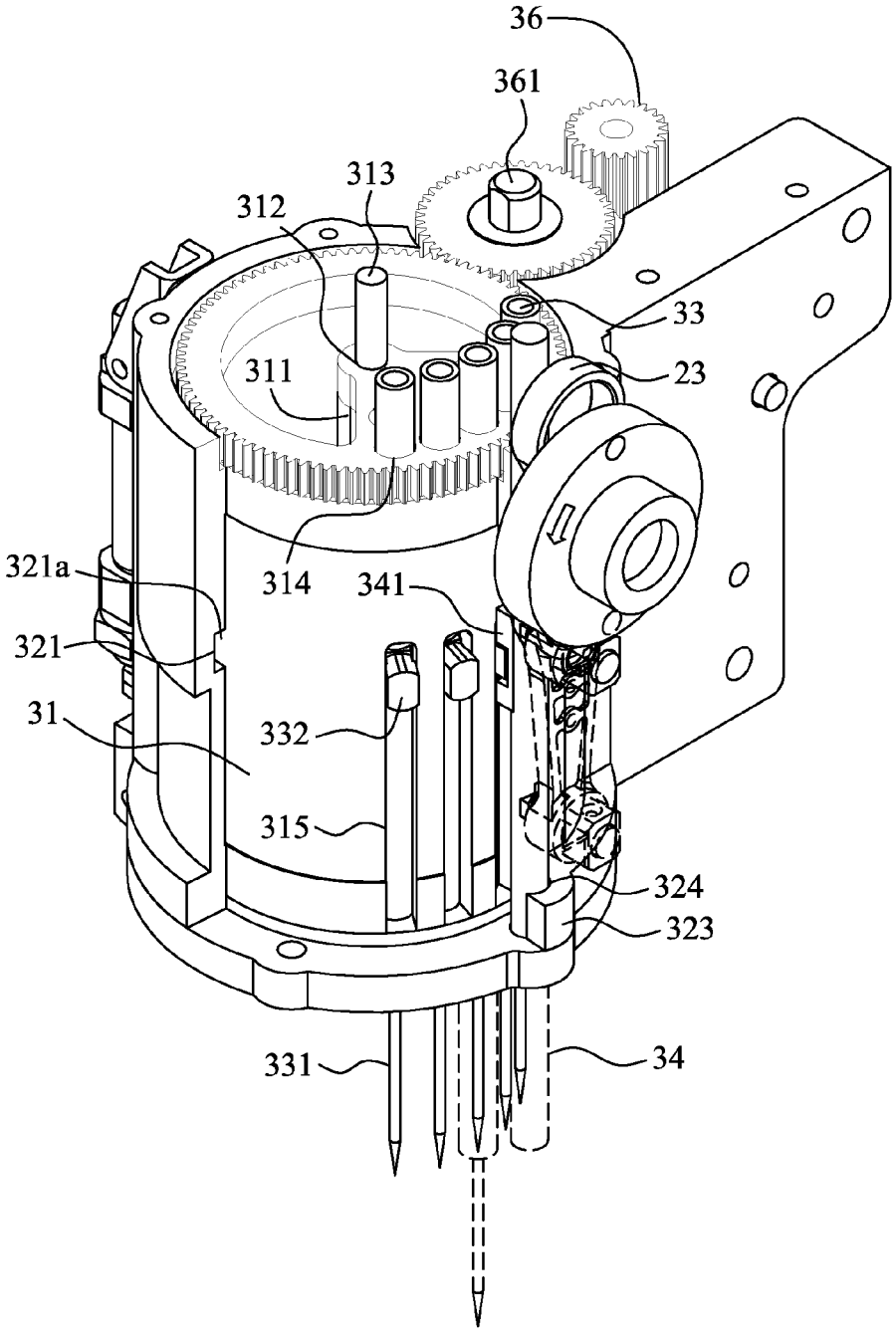
FIG. 10 is a partially cut-away view of the first preferred embodiment of the present invention showing the use of one needle in a selected needle bar to sew.

As can be seen from FIGS. 9 and 10, when the cylindrical needle bar case 31 is driven by the driving motor 351 and the gear set 361 to rotate, the needle bar 33 in any one of the needle bar holes 314 can be selectively moved to a sewing position, at which the needle bar 33 is radially in line with the longitudinal opening 322 and the needle bar guide member 34. The needle bar 33 being selectively moved to the sewing position will become engaged with the needle bar guide member 34 to axially move upward and downward synchronously with the latter. As to the rest needle bars 33 that are not moved to the sewing position, they are restricted by the control guide way 321 from axially moving upward and downward.

Figure 11:
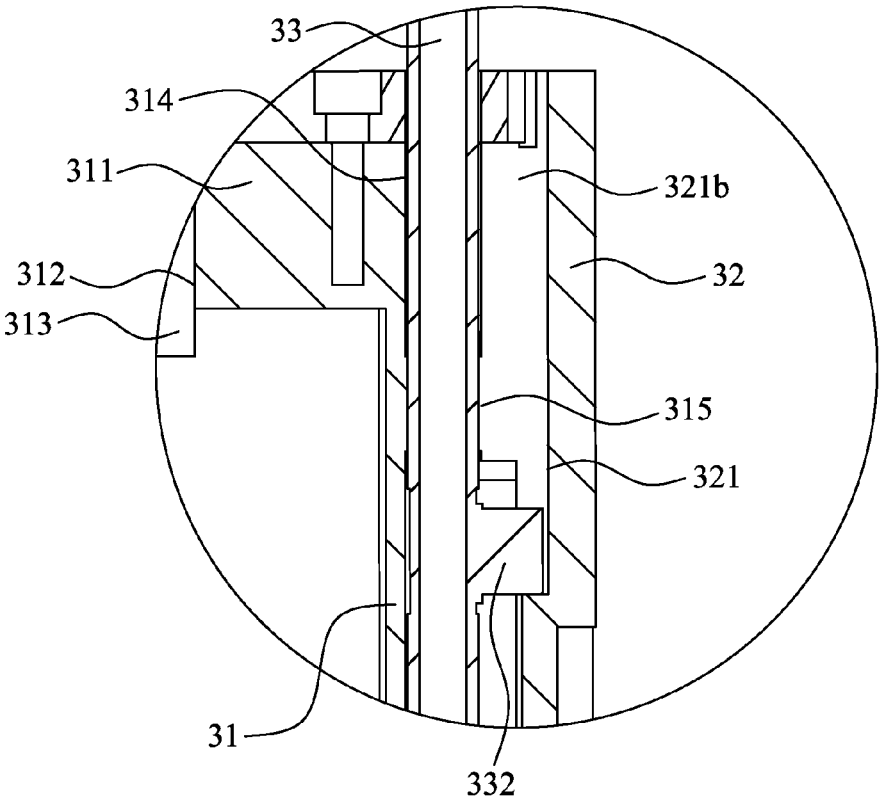
FIG. 11 is a partially enlarged sectional view showing a rabbet-type control guide way according to another variant of the first preferred embodiment of the present invention.

In the first preferred embodiment of the present invention, the control guide way 321 is configured as a groove 321*a* having an upper and a lower side to provide an axial limiting effect and can be correspondingly engaged with the first protrusions 332 on the needle bars 33. However, as can be seen in FIG. 11, according to a variant of the first preferred embodiment, the control guide way 321 can be otherwise configured as a rabbet 321*b* having a lower side, which serves as a support to press against the first protrusions 332 on the needle bars 33, and an open upper side. With this configuration, the needle bars 33, due to their own weight, can still rest on the rabbet-type control guide way 321*b* and maintain at a fixed axial position in the needle bar case holder 32.

Figure 12:
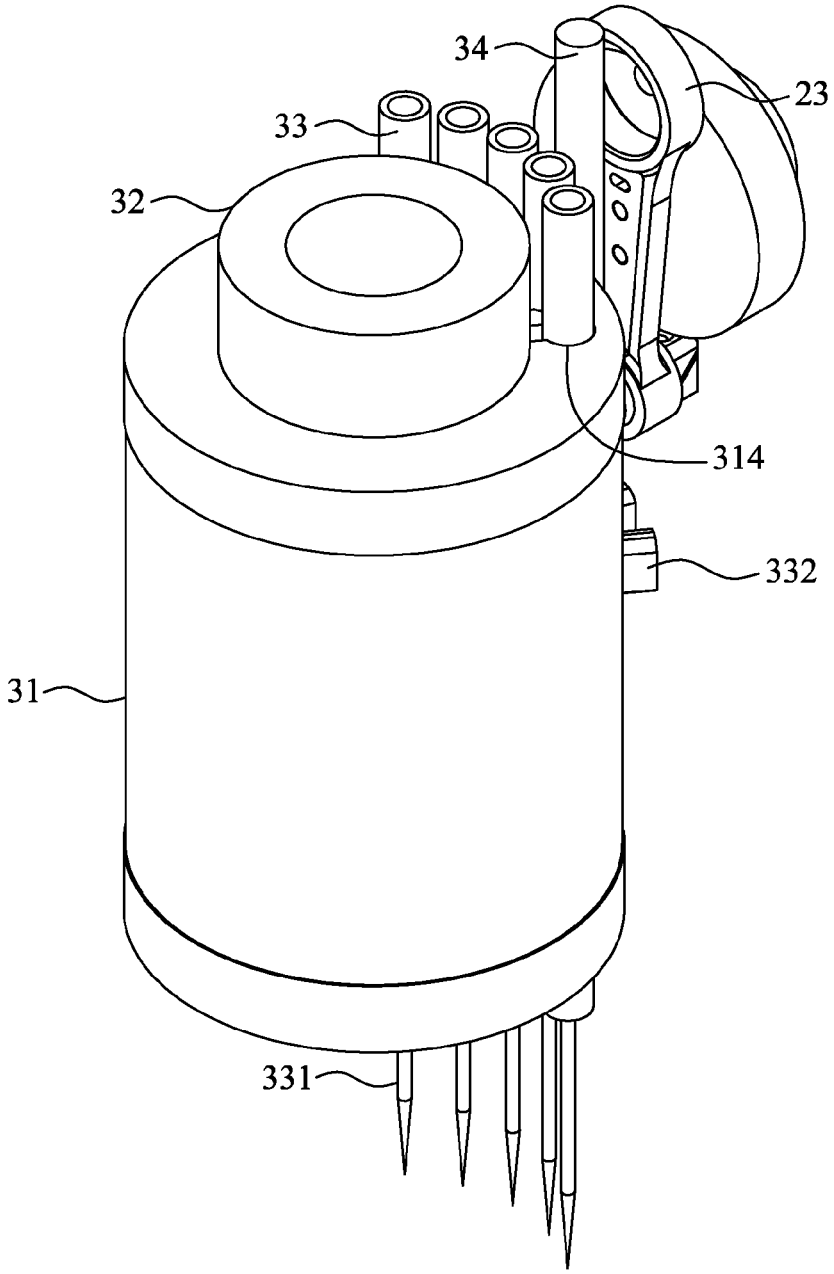
FIG. 12 is an assembled perspective view of a round-type sewing machine needle bar changing device according to a second preferred embodiment of the present invention.
Figure 13:
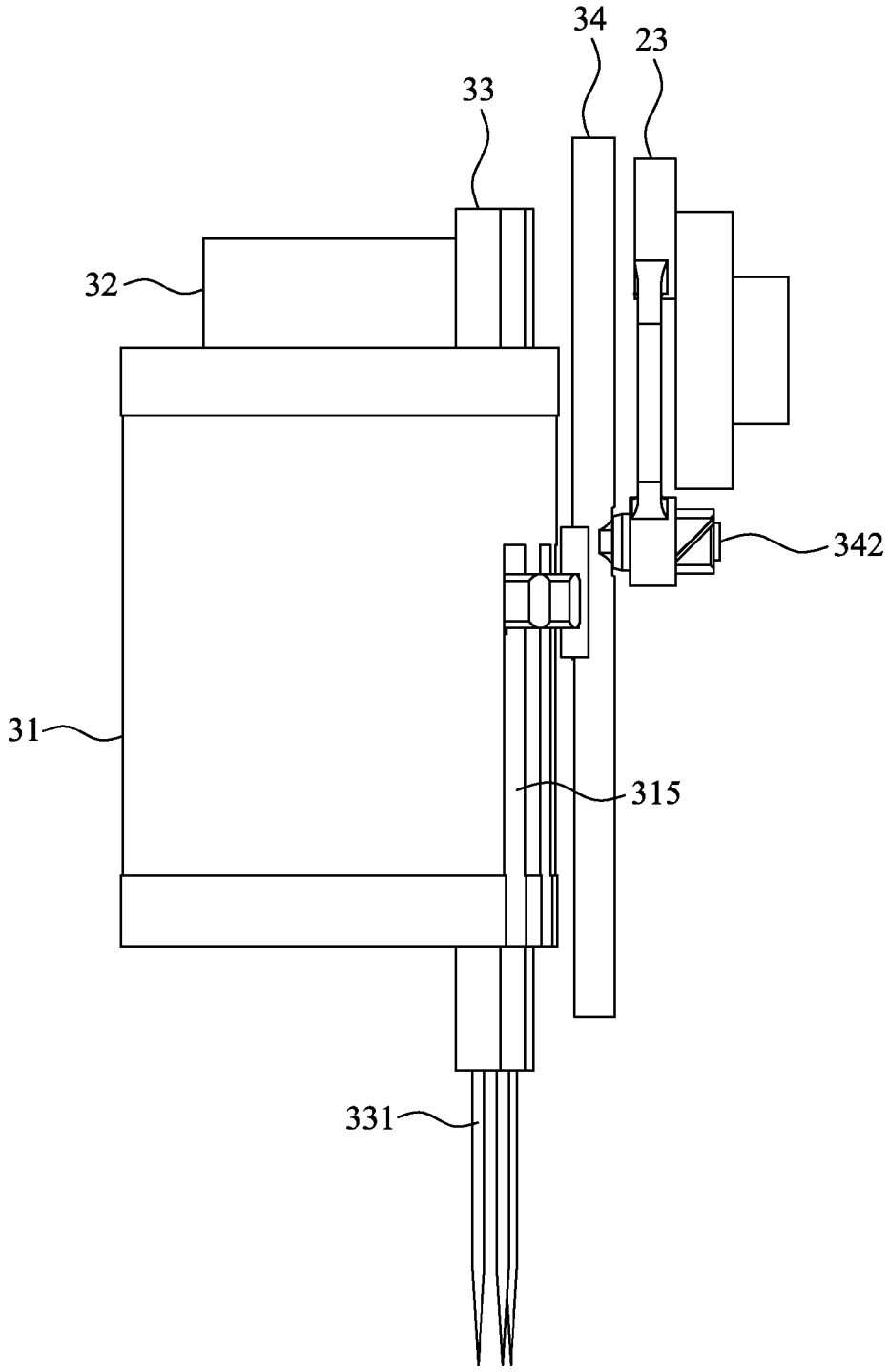
FIG. 13 is a side view of FIG. 12.

FIGS. 12 and 13 illustrate a second preferred embodiment of the present invention, which similarly includes a cylindrical needle bar case 31, a cylindrical needle bar case holder 32, a plurality of needle bars 33 each carrying a needle 331, a needle bar guide member 34, and a driving mechanism 35 (not shown in FIGS. 12 and 13). The second preferred embodiment is different from the first one mainly in the positions of the cylindrical needle bar case holder 32 and the needle bar guide member 34 relative to the cylindrical needle bar case 31. In the first preferred embodiment, the cylindrical needle bar case holder 32 and the needle bar guide member 34 are located at the same side of the cylindrical needle bar case 31, while in the second preferred embodiment the cylindrical needle bar case holder 32 and the needle bar guide member 34 are located at two opposite sides of the cylindrical needle bar case 31.

Due to the change in the relative positions of the cylindrical needle bar case holder 32 and the needle bar guide member 34 to the cylindrical needle bar case 31, the second preferred embodiment has some parts different from the first preferred embodiment. The following description of the second preferred embodiment omits the parts identical to the first preferred embodiment and only the different parts, namely, the cylindrical needle bar case 31, the cylindrical needle bar case holder 32 and the needle bars 33 are particularly described.

Figure 14:
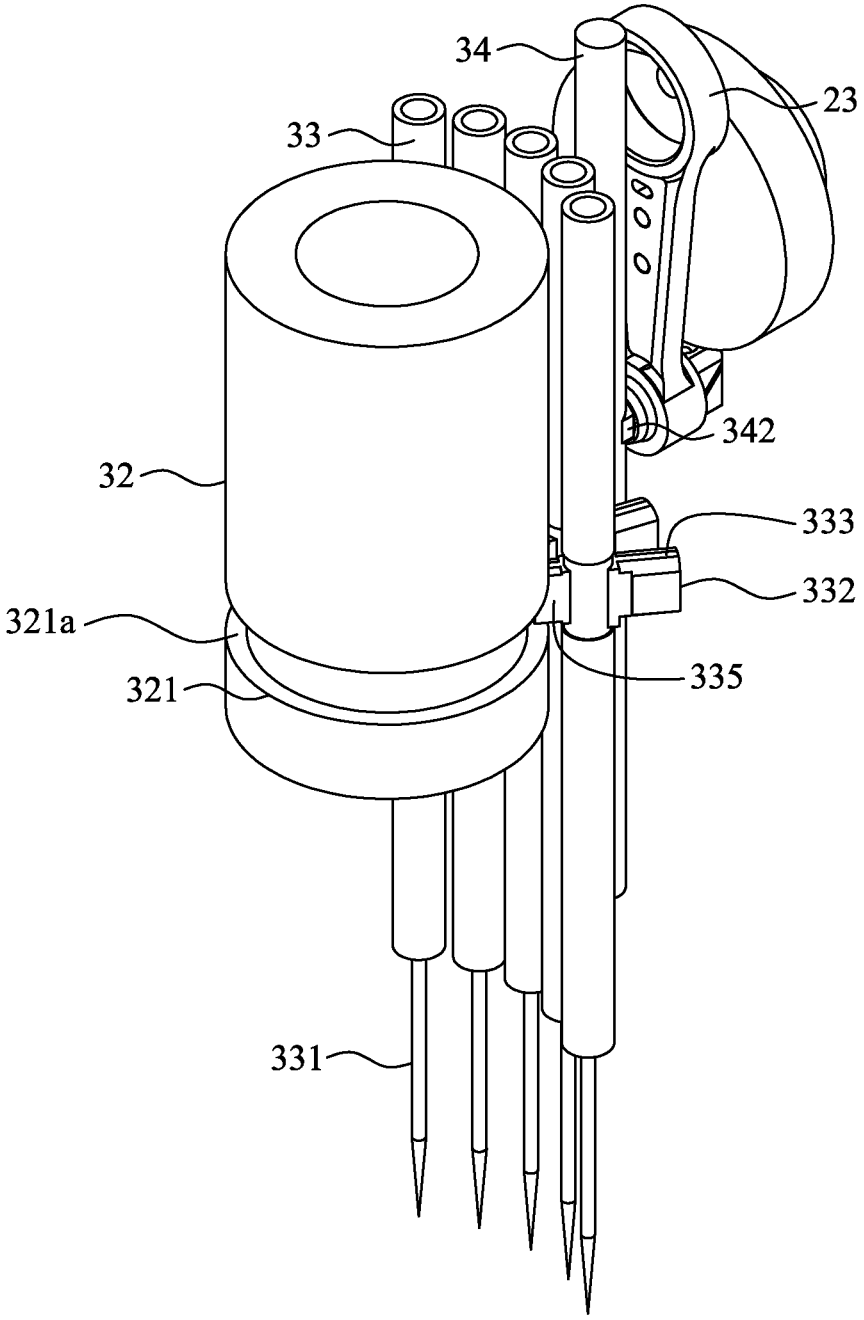
FIG. 14 is another perspective view similar to FIG. 12 with a cylindrical needle bar case removed therefrom.
Figure 15:
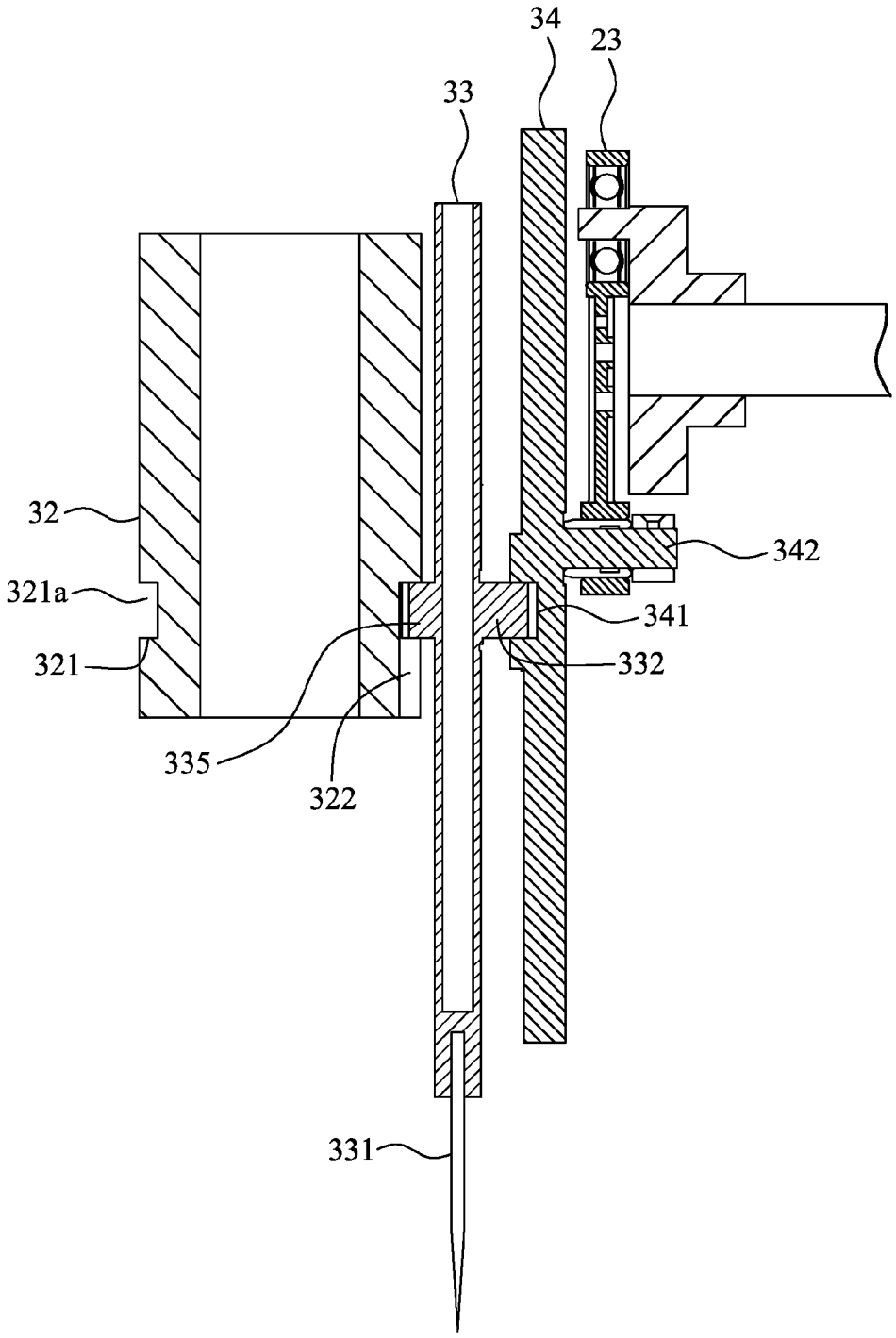
FIG. 15 is a sectional view of FIG. 14.

Please refer to FIGS. 14 and 15. In the second preferred embodiment, every needle bar hole 314 on the cylindrical needle bar case 31 has two longitudinal slide ways 315 (not shown in FIGS. 14 and 15) formed on two diametrically opposite sides of its wall surface, or more specifically, on a radially inner and a radial outer side of its wall surface; the cylindrical needle bar case holder 32 is fitted in the cylindrical needle bar case 31 and has a control guide way 321 formed on around an outer wall surface thereof to face toward all the longitudinal slide ways 315 on the radially inner side of the cylindrical needle bar case 31; and every needle bar 33 has a first protrusion 332 and a second protrusion 335 formed on two diametrically opposite sides of an outer surface thereof. The first protrusions 332 are radially outward extended through the longitudinal slide ways 315 formed on the radially outer side of the cylindrical needle bar case 31 to finally engage with the needle bar guide member 34. On the other hand, the second protrusions 335 are radially inward extended through the longitudinal slide ways 315 formed on the radially inner side of the cylindrical needle bar case 31 to finally engage with the control guide way 321 on the cylindrical needle bar case holder 32. One of the needle bars 33 located corresponding to the longitudinal opening 322 is allowed to axially move upward and downward.

Figure 16:
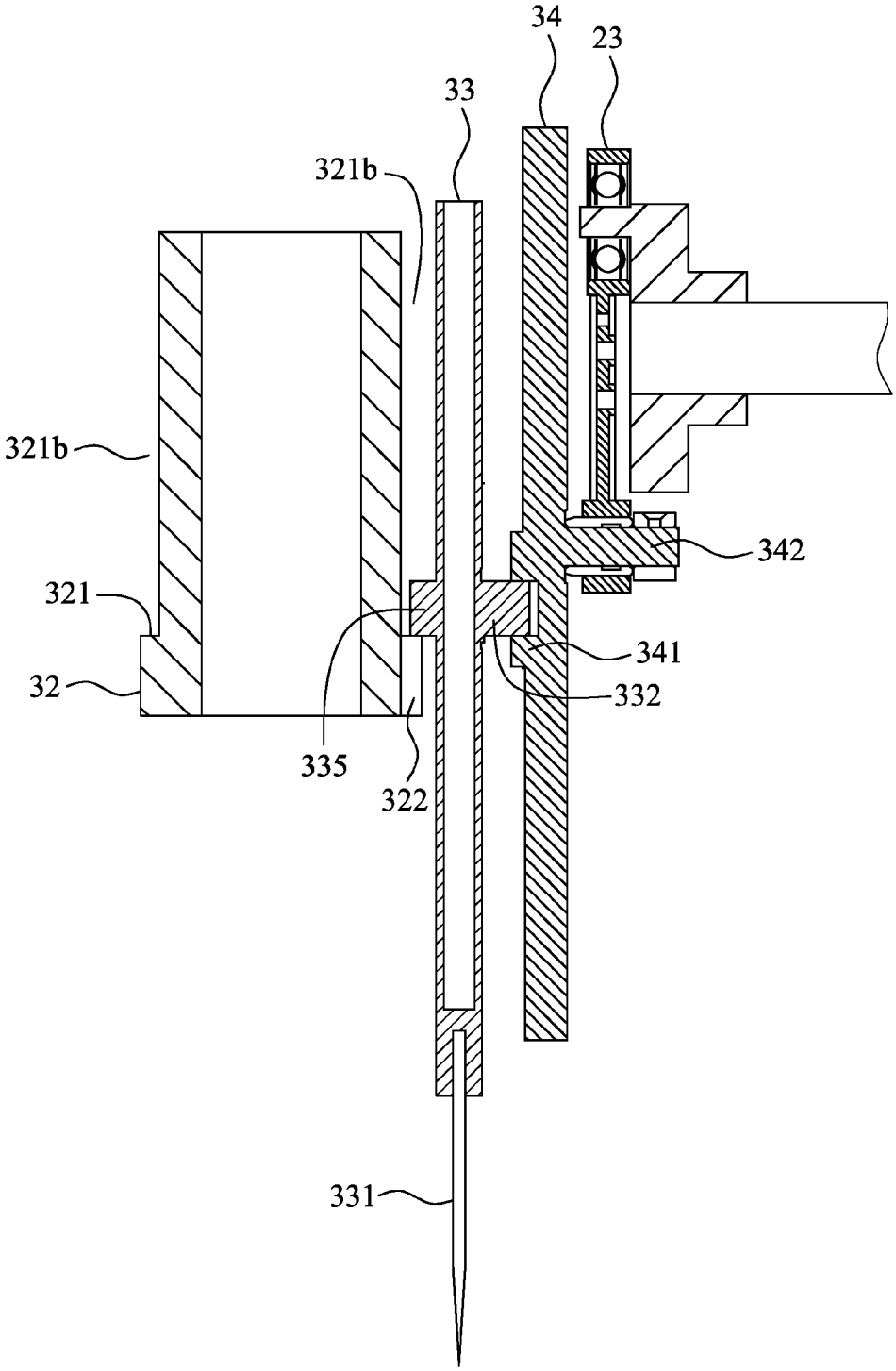
FIG. 16 is a sectional view showing a first variant of the second preferred embodiment of the present invention having a rabbet-type control guide way.

FIG. 16 is a sectional view showing a first variant of the second preferred embodiment of the present invention. In the second preferred embodiment shown in FIG. 15, the control guide way 321 is in the form of a groove 321*a*. However, in the first variant of the second preferred embodiment shown in FIG. 16, the control guide way 321 can be a rabbet 321*b* similar to that shown in FIG. 11, i.e. having an open upper end and a lower side serving as a support to press against the second protrusions 335. Again, with this configuration, the needle bars 33, due to their own weight, can still rest on the rabbet-type control guide way 321*b* and maintain at a fixed axial position outside the needle bar case holder 32.

Figure 17:
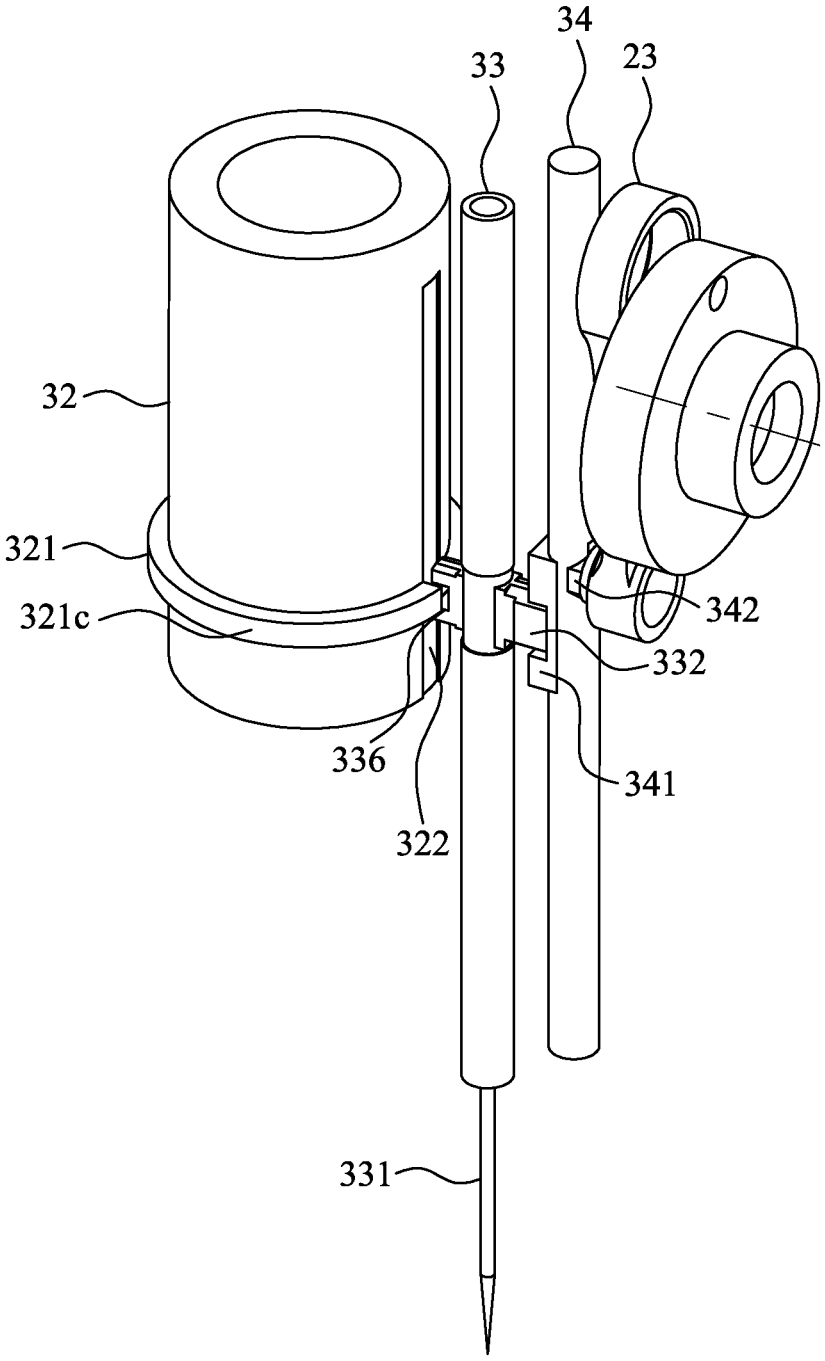
FIG. 17 is an assembled perspective view showing a second variant of the second preferred embodiment of the present invention having a flange-type control guide way.
Figure 18:
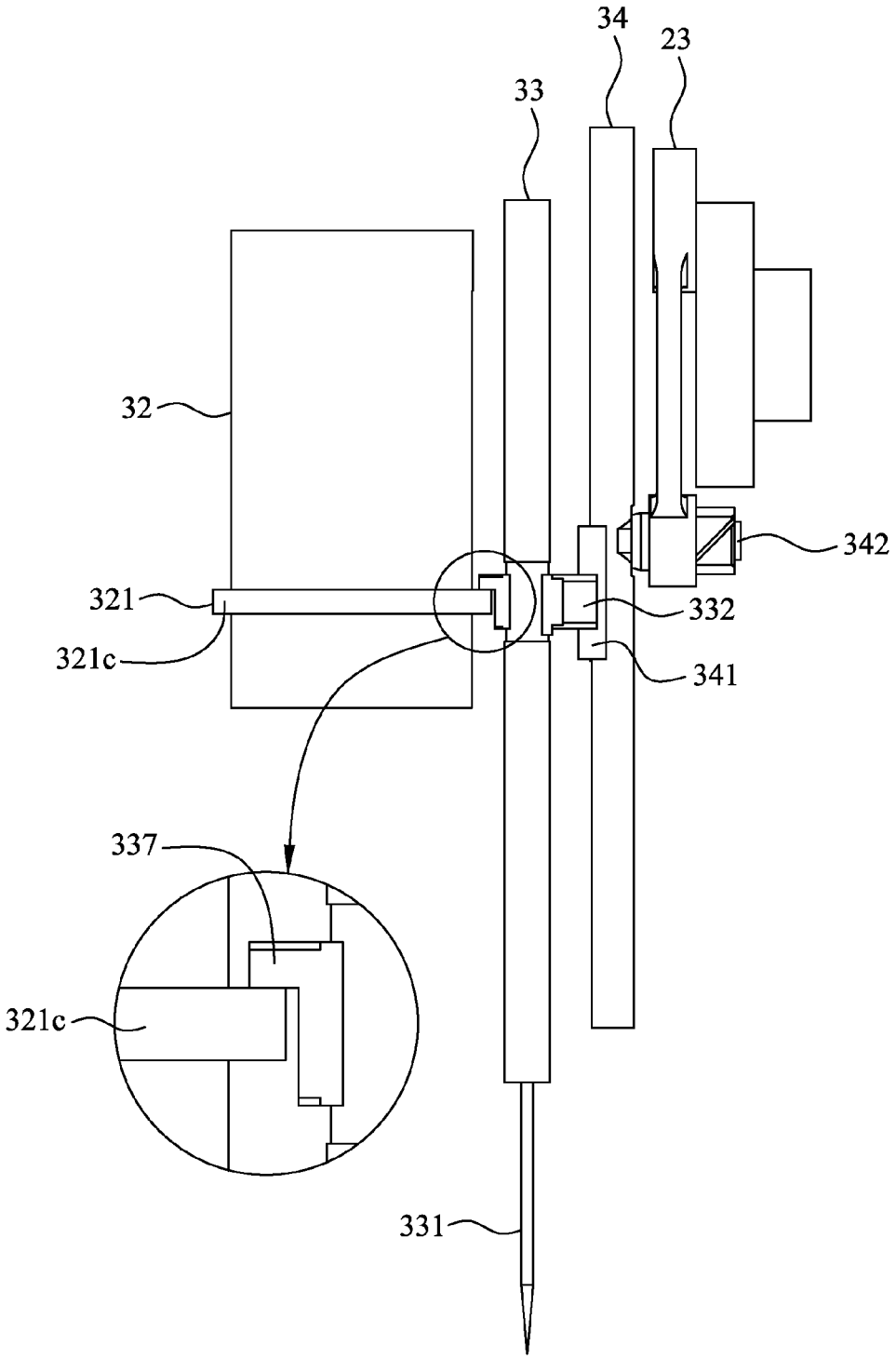
FIG. 18 and a partially enlarged view thereof show the needle bar for the present invention is provided with a stopper corresponding to the flange-type control guide way shown in FIG. 17.

In any of the above-described preferred embodiments, the cylindrical needle bar case holder 32 has a groove-type control guide way 321 for correspondingly engaging with the first protrusions 332 or the second protrusions 335 on the needle bars 33. However, these embodiments are only illustrative and not intended to limit the way by which the control guide way 321 and the needle bars 33 of the present invention are engaged with one another. For example, in a second variant of the second preferred embodiment shown in FIG. 17, the control guide way 321 can be otherwise an annular flange 321*c* formed on around the outer surface of the cylindrical needle bar case holder 32, and the needle bars 33 can respectively have a recess 336 formed thereon for engaging with the annular flange 321*c*. Alternatively, in a further variant of the second preferred embodiment as shown in FIG. 18, the control guide way 321 is in the form of the annular flange 321*c*, while the needle bars 33 can respectively have a stopper 337 for pressing against a top of the annular flange 321*c* to maintain at a fixed axial position outside the needle bar case holder 32.

According to the above two embodiments, it is understood that, no matter how the cylindrical needle bar case holder 32 and the needle bar guide member 34 are located relative to the needle bar case 31, and no matter how the needle bars 33 are engaged with the needle bar guide member 34 and the cylindrical needle bar case holder 32, these different arrangements all fall in the technical scope of the present invention.

Figure 19:
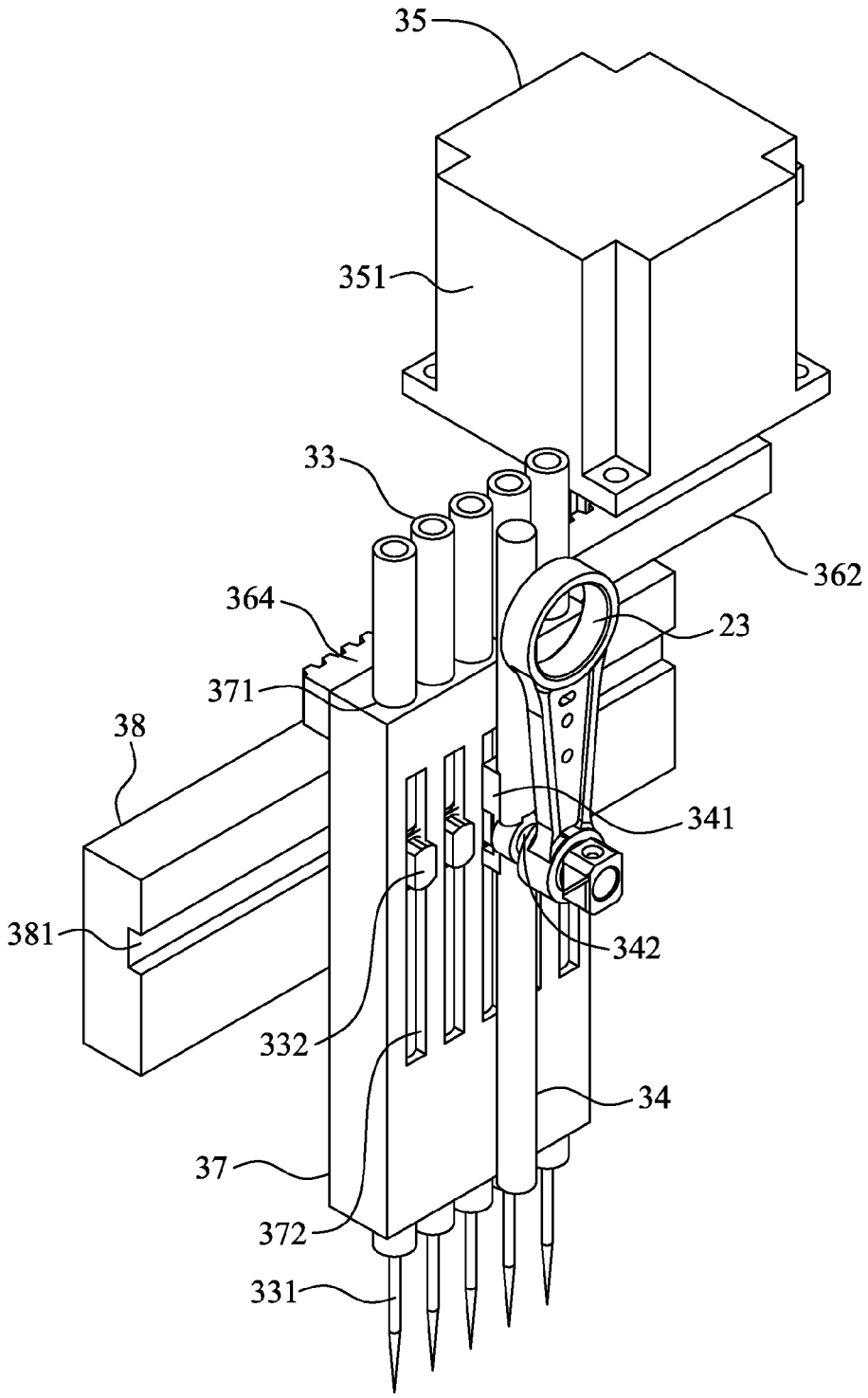
FIG. 19 is an assembled perspective view of a linear-type sewing machine needle bar changing device according to a third preferred embodiment of the present invention.

FIG. 19 is an assembled perspective view of a third preferred embodiment of the present invention. In the third preferred embodiment, the sewing machine needle bar changing device 30 includes a linear needle bar case 37, a linear needle bar case holder 38, a plurality of needle bars 33 each carrying a needle 331, a needle bar guide member 34, and a driving mechanism 35.

Figure 20:
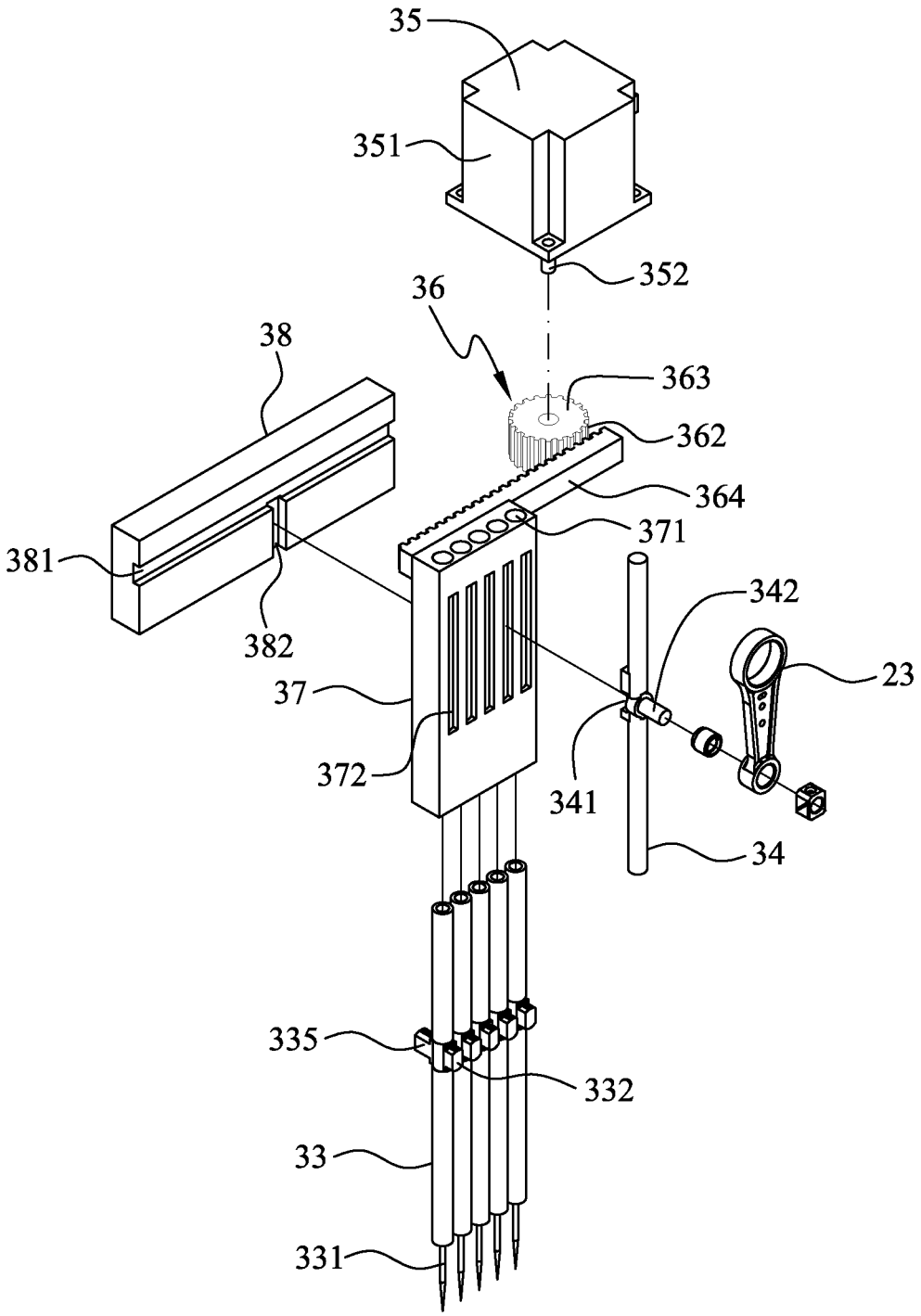
FIG. 20 is an exploded view of FIG. 19.
Figure 21:
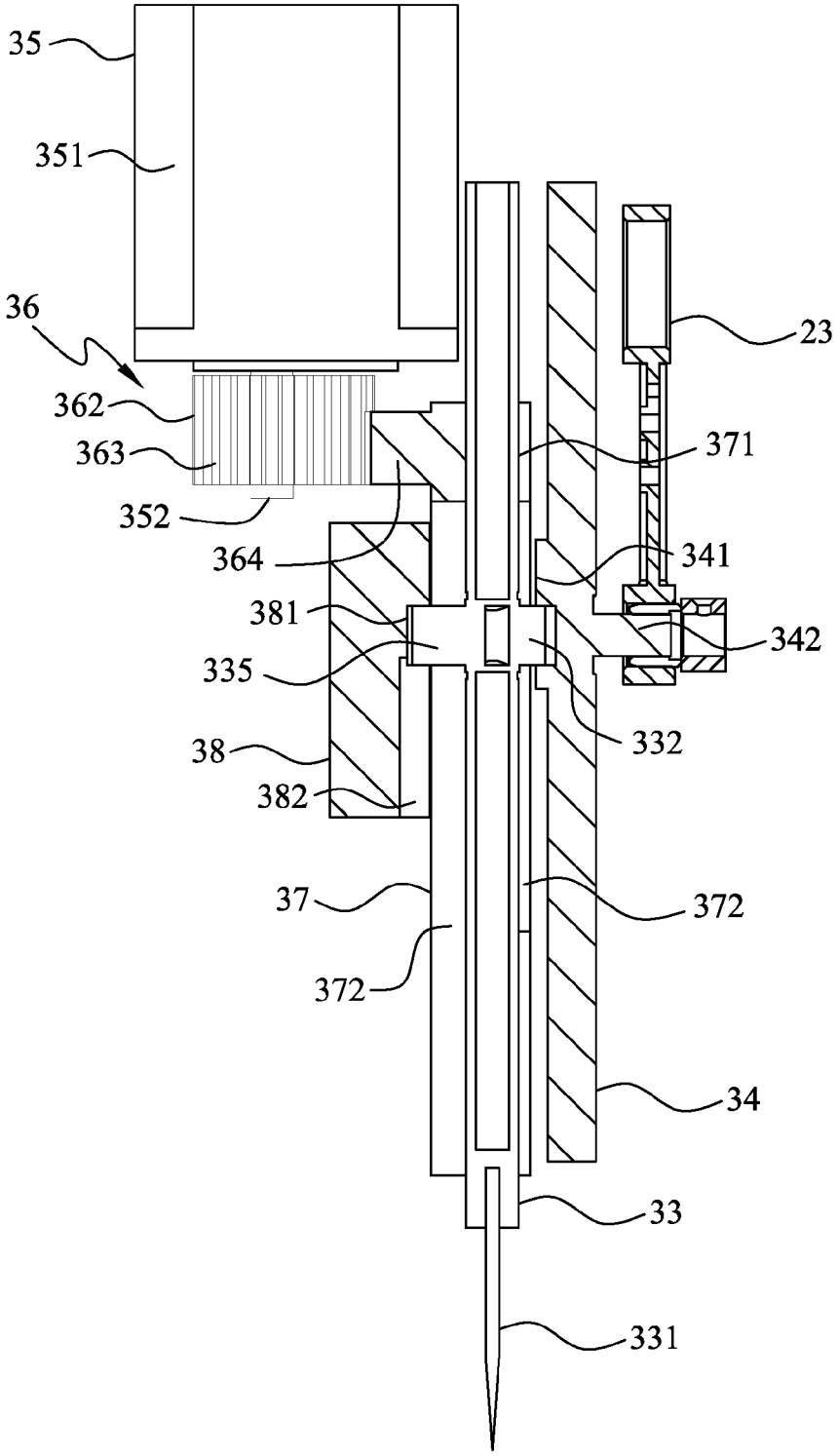
FIG. 21 is a sectional view of FIG. 19.

Please also refer to FIGS. 20 and 21, which are exploded perspective view and assembled sectional view of FIG. 19, respectively. The linear needle bar case 37 includes a plurality of linearly spaced needle bar holes 371 and is provided on two opposite sides of its outer wall with a plurality of longitudinal slide ways 372 corresponding to and communicating with the needle bar holes 371, so that each of the needle bar holes 371 has two longitudinal guide ways 372 facing toward two opposite directions. Further, the longitudinal slide ways 372 are located in a near middle section of the linear needle bar case 37.

The linear needle bar case holder 38 is located at one side of the linear needle bar case 37 and has a horizontal control guide way 381 formed on a face adjacent to the linear needle bar case 37. The control guide way 381 transversely faces toward all the longitudinal slide ways 372 and further includes a vertically extended longitudinal opening 382.

The needle bars 33 are received in the needle bar holes 371 of the linear needle bar case 37 in one-to-one correspondence. Each of the needle bars 33 has a first protrusion 332 and a second protrusion 335 formed on two diametrically opposite sides of an outer surface thereof. The first protrusions 332 are outwardly extended through the longitudinal slide ways 372 formed on the side of the linear needle bar case 37 facing away from the linear needle bar case holder 38. On the other hand, the second protrusions 335 are outwardly extended through the longitudinal slide ways 372 formed on the side of the linear needle bar case 37 facing toward the linear needle bar case holder 38 to engage with the control guide way 381.

The needle bar guide member 34 is located at the side of the linear needle bar case 37 opposite to the linear needle bar case holder 38, and has a first recess 341 formed thereon for correspondingly engaging with one of the needle bars 33 that is located in line with the longitudinal opening 382. A connecting arm 342 is also formed on one side of the needle bar guide member 34 opposite to the first recess 341 for connecting to the crank link 23, such that the needle bar guide member 34 is brought by the crank link 23 to move upward and downward.

Since the first protrusions 332 and the second protrusions 335 in the third preferred embodiment also have contact surfaces being structured like the contact surfaces for the first protrusions 332 in the first preferred embodiment, they are not repeatedly described herein. Further, the above-described manner of engagement of the needle bar 33 with the needle bar guide member 34 is also illustrative, and many other different engagement structures providing similar function are also included in the scope of the present invention.

In the illustrated third preferred embodiment, the driving mechanism 35 includes a driving motor 351 and a gear set 362. The driving motor 351 is also a step motor with a locating function and has a driving shaft 352. The gear set 362 includes a gear 363 located at one end thereof for rotatably connecting to the driving shaft 352, and a toothed rack 364 located at another end thereof. The toothed rack 364 is fixedly mounted to one side of the linear needle bar case 37 and meshes with the gear 363, so as to bring the linear needle bar case 37 to displace linearly.

Figure 22:
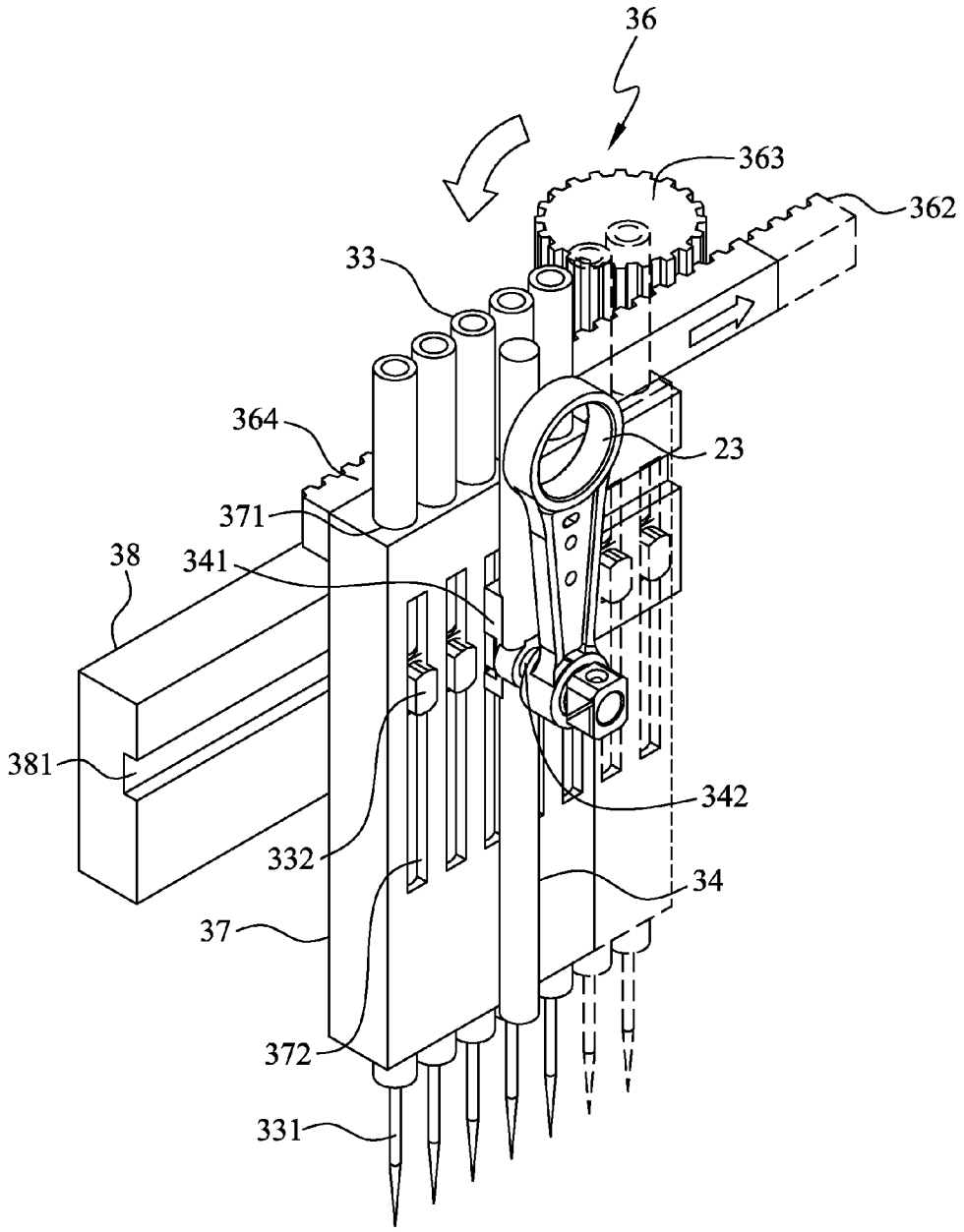
FIG. 22 shows the third preferred embodiment of the present invention is driven to change the needle bars for one to another.

Please refer to FIG. 22. When the driving motor 351 drives the toothed rack 364 of the gear set 362 and accordingly, the linear needle bar case 37 to displace linearly, one of the needle bars 33 in the needle bar holes 371 is selectively moved to a sewing position, at which the needle bar 33 is in line with the longitudinal opening 382 on the linear needle bar case holder 38 and the needle bar guide member 34. The needle bar 33 being selectively moved to the sewing position will become engaged with the needle bar guide member 34 to axially move upward and downward synchronously with the latter.

Figure 23:
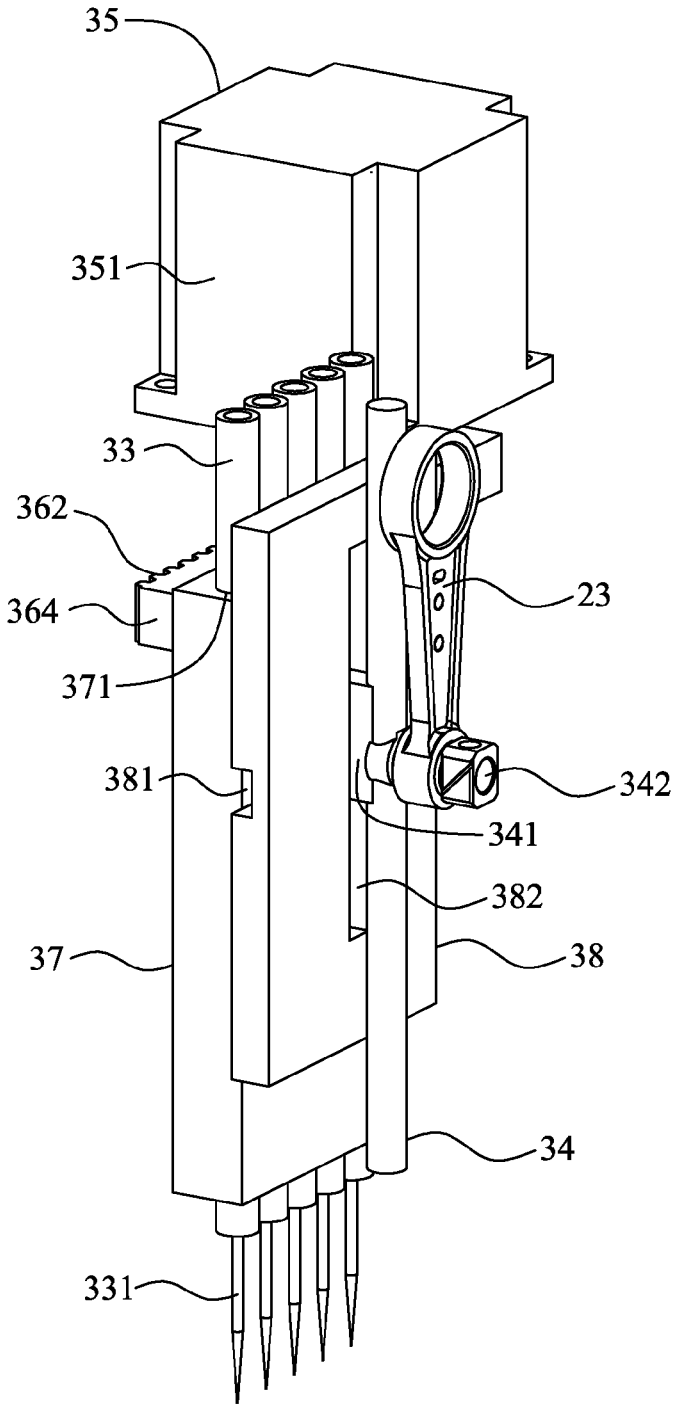
FIG. 23 is an assembled perspective view of a linear-type sewing machine needle bar changing device according to a fourth preferred embodiment of the present invention.

FIG. 23 illustrates a fourth preferred embodiment of the present invention, which also includes a linear needle bar case 37, a linear needle bar case holder 38, a plurality of needle bars 33 each carrying a needle 331, a needle bar guide member 34, and a driving mechanism 35. The fourth preferred embodiment is different from the third preferred embodiment mainly in the positions of the linear needle bar case 37 and the linear needle bar case holder 38 relative to the needle bar guide member 34.

Figure 24:
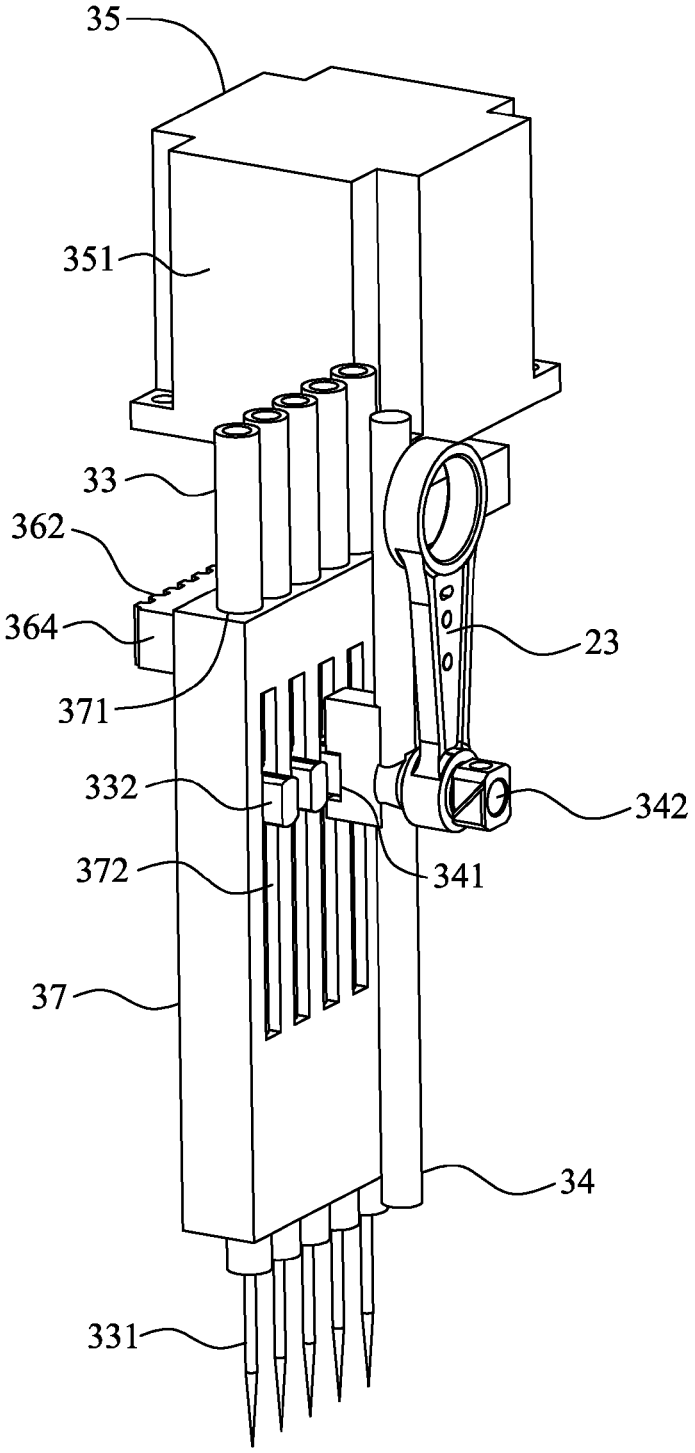
FIG. 24 is another perspective view similar to FIG. 23 with a linear-type needle bar case holder removed therefrom.
Figure 25:
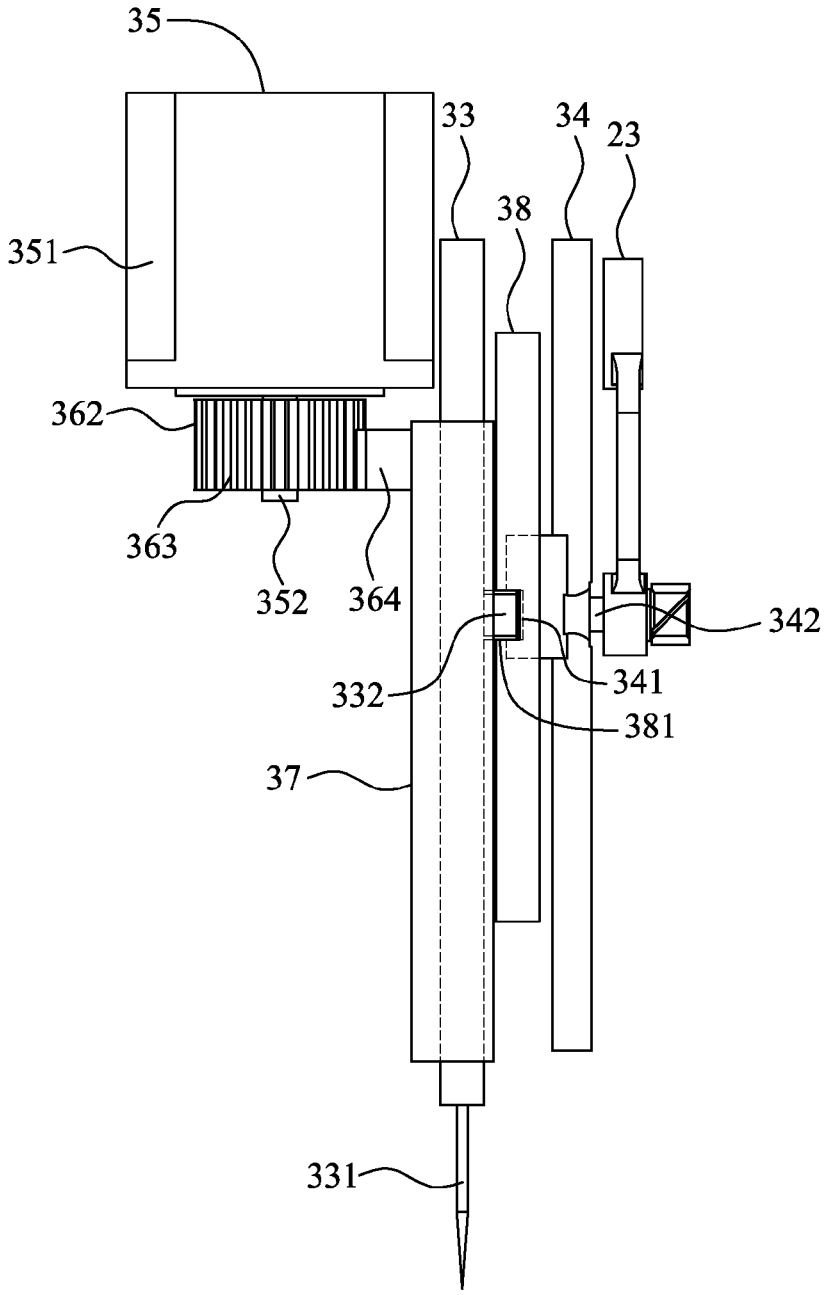
FIG. 25 is a front view of FIG. 23 showing the engagement of one needle bar with a needle bar guide member.

Please refer to FIGS. 24 and 25 along with FIG. 23. In the fourth preferred embodiment, the needle bar holes 371 on the linear needle bar case 37 respectively have one single longitudinal slide way 372 formed on one side facing toward the needle bar guide member 34; the linear needle bar case holder 38 is located between the linear needle bar case 37 and the needle bar guide member 34, and is provided on one side adjacent to the linear needle bar case 37 with a horizontal control guide way 381, which transversely faces toward all the longitudinal slide ways 372 and has a vertically extended longitudinal opening 382; and each of the needle bars 33 in the needle bar holes 371 has a first protrusion 332 for extending through the corresponding longitudinal slide way 372 to engage with the control guide way 381. The first protrusion 332 on a selected needle bar 33 that is moved to the aforesaid sewing position can engage with the longitudinal opening 382 of the control guide way 381. All other parts in the fourth preferred embodiment are similar to those in the third preferred embodiment and are therefore not repeatedly described herein.

Figure 26:
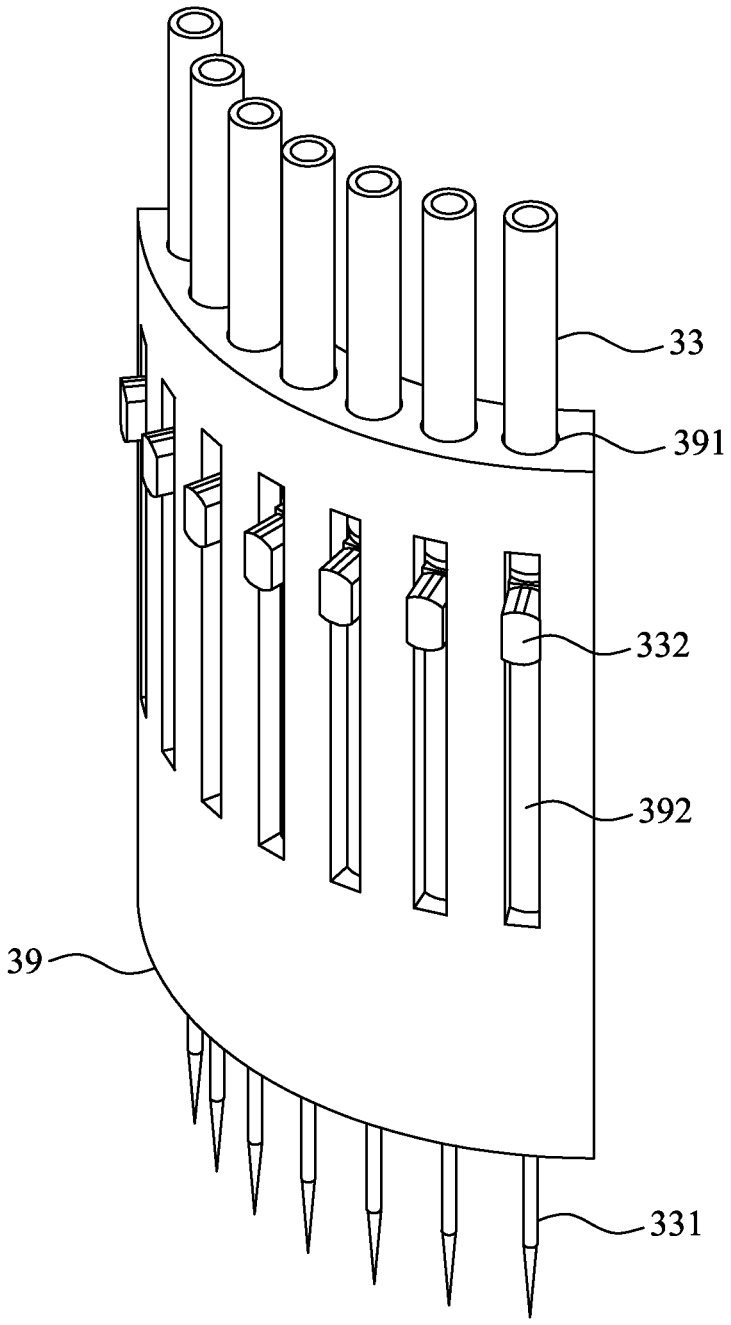
FIG. 26 is a perspective view of a curvilinear-type needle bar case for the present invention.

In addition to the cylindrical and the linear configuration, the needle bar case for the present invention can, of course, still have other different shapes. For example, in FIG. 26, there is shown a curvilinear needle bar case 39, on which multiple needle bar holes 391 are spaced along a curved line. Each of the needle bar holes 391 has a longitudinal slide way 392 formed on one side thereof and carries a needle 33. The curved needle bar case 39 can be driven by the driving mechanism 35 to sway from side to side, so as to change the positions of the needle bar holes 391 relative to the needle bar guide member 34.

Moreover, the transmission unit 36 in the driving mechanism 35 is not limited to the gear set 361 and the gear set 362 in the aforesaid four preferred embodiments, but can be many other types of transmission mechanisms, including but not limited to a belt-driving unit, a guide screw unit, an actuator, an electrical driving unit, and other final controlling elements, which all can exactly achieve the purpose of power transmission and provide the locating effect.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A sewing machine needle bar changing device, comprising:

a cylindrical needle bar case having
- longitudinal slide ways,
- a pivoting section, and
- a plurality of spaced needle bar holes on a portion of the needle bar case so as to be circumferentially arrayed, each of the needle bar holes having on at least one side thereof at least one of the longitudinal slide ways which communicates the needle bar hole with an external space;

a cylindrical needle bar case holder being located at one side of the cylindrical needle bar case and having a control guide way formed thereon, the control guide way having a longitudinal opening, and facing towards each of the longitudinal slide ways;

a plurality of needle bars being received in the needle bar holes in a one-to-one correspondence and each carrying a needle, the needle bars in the needle bar holes being engaged with the longitudinal slide ways and the control guide way at a same time so as to both
- prevent the needle bars from rotating in the needle bar holes, and limit axial motion of the needle bars except a first needle bar of the needle bars that is moved to align with the longitudinal opening;

a needle bar guide member being engaged with the first needle bar that is moved to align with the longitudinal opening, the needle bar guide member being connected to and brought by a crank link on a sewing machine to move upward and downward; and a driving mechanism connected to the pivoting section for driving the cylindrical needle bar case to display by rotating and providing a locating function, so as to change positions of the needle bar holes relative to the needle bar guide member, so that a selected one needle bar hole of the needle bar holes is selectively rotated to a sewing position, at which the needle bar in the selected one needle bar hole is in line with the longitudinal opening and the needle bar guide member, the needle bar in the selected one needle bar hole that is selected and rotated to the sewing position can be brought by the needle bar guide member to axially move upward and downward synchronously with the needle bar guide member, while all other needle bars of the needle bars that are not located at the sewing position are restricted by the control guide way from axially moving upward and downward.

2. The sewing machine needle bar changing device as claimed in claim 1, wherein the cylindrical needle bar case holder and the needle bar guide member are located at a same side of the cylindrical needle bar case.

3. The sewing machine needle bar changing device as claimed in claim 2, wherein the needle bars respectively have a first protrusion for engaging with the control guide way, and further wherein the needle bar guide member has a first recess corresponding to the first protrusions, so that the needle bar that is in the selected one needle bar hole and is located at the sewing position can move synchronously with the needle bar guide member through engagement of the first protrusion of the needle bar in the selected one needle bar hole with the first recess.

4. A sewing machine needle bar changing device, comprising:

a needle bar case having longitudinal slide ways, a plurality of spaced needle bar holes, each of the needle bar holes having on at least one side thereof at least one of the longitudinal slide ways which communicates the needle bar hole with an external space;

a needle bar case holder being located at one side of the cylindrical needle bar case and having a control guide way formed thereon, the control guide way having a longitudinal opening;

a plurality of needle bars being received in the needle bar holes in a one-to-one correspondence and each carrying a needle, the needle bars in the needle bar holes being engaged with the longitudinal slide ways and the control guide way;

a needle bar guide member being engaged with a needle bar of the needle bars that is moved to align with the longitudinal opening, the needle bar guide member being connected to and brought by a crank link on a sewing machine to move upward and downward; and a driving mechanism for driving the needle bar case to displace and providing a locating function, so that a selected one needle bar hole of the needle bar holes is selectively moved to a sewing position, at which the needle bar in the selected one needle bar hole is in line with the longitudinal opening and the needle bar guide member, the needle bar in the selected one needle bar hole that is selected and moved to the sewing position can be brought by the needle bar guide member to axially move upward and downward synchronously with the needle bar guide member, while all other needle bars of the needle bars that are not located at the sewing position are restricted by the control guide way from axially moving upward and downward, wherein the cylindrical needle bar case holder and the needle bar guide member are located at a same side of the cylindrical needle bar case wherein the needle bars respectively have a recess for engaging with the control guide way, and further wherein the needle bar guide member has a protrusion corresponding to the recesses on the needle bars, so that the needle bar that is in the selected one needle bar hole and is located at the sewing position can move synchronously with the needle bar guide member through engagement of the recess of the needle bar that is in the selected one needle bar hole with the protrusion.

5. The sewing machine needle bar changing device as claimed in claim 1, wherein the cylindrical needle bar case holder and the needle bar guide member are located at two opposite sides of the cylindrical needle bar case.

6. The sewing machine needle bar changing device as claimed in claim 5, wherein the needle bars respectively have a first protrusion and a second protrusion formed thereon, further wherein the needle bar guide member has a first recess corresponding to the first protrusions;

further wherein the second protrusions are engaged with the control guide way; and further wherein the first protrusion on the needle bar that is in the selected one needle bar hole and that is located at the sewing position being engaged with the first recess for the needle bar that is in the selected one needle bar hole to move synchronously with the needle bar guide member.

7. The sewing machine needle bar changing device as claimed in claim 1, wherein the control guide way is one selected from the group consisting of a groove formed on a wall surface of the cylindrical needle bar case holder and a rabbet formed on a wall surface of the cylindrical needle bar case holder, and each of the needle bars correspondingly has one protrusion formed thereon corresponding to the one of the groove and the rabbet.

8. A sewing machine needle bar changing device, comprising:

a needle bar case having longitudinal slide ways, a plurality of spaced needle bar holes, each of the needle bar holes having on at least one side thereof at least one of the longitudinal slide ways which communicates the needle bar hole with an external space;

a needle bar case holder being located at one side of the cylindrical needle bar case and having a control guide way formed thereon, the control guide way having a longitudinal opening;

a plurality of needle bars being received in the needle bar holes in a one-to-one correspondence and each carrying a needle, the needle bars in the needle bar holes being engaged with the longitudinal slide ways and the control guide way;

a needle bar guide member being engaged with a needle bar of the needle bars that is moved to align with the longitudinal opening, the needle bar guide member being connected to and brought by a crank link on a sewing machine to move upward and downward; and a driving mechanism for driving the needle bar case to displace and providing a locating function, so that a selected one needle bar hole of the needle bar holes is selectively moved to a sewing position, at which the needle bar in the selected one needle bar hole is in line with the longitudinal opening and the needle bar guide member, the needle bar in the selected one needle bar hole that is selected and moved to the sewing position can be brought by the needle bar guide member to axially move upward and downward synchronously with the needle bar guide member, while all other needle bars of the needle bars that are not located at the sewing position are restricted by the control guide way from axially moving upward and downward, wherein the control guide way is an annular flange formed on around a wall surface of the cylindrical needle bar case holder, and each of the needle bars has one selected from the group consisting of a recess corresponding to the annular flange and a stopper for pressing against a top of the annular flange.

* * * * *